US008367595B2

(12) United States Patent
Cheung et al.

(10) Patent No.: US 8,367,595 B2
(45) Date of Patent: Feb. 5, 2013

(54) SOLID TREATMENT BLOCKS FOR SANITARY APPLIANCES

(75) Inventors: Tak Wai Cheung, Yuma, AZ (US); Robert Zhong Lu, Montvale, NJ (US); Dana Moseson, Havertown, PA (US); Steven Wu, Montvale, NJ (US)

(73) Assignee: Reckitt Benckiser LLC, Parsippany, NJ (US)

( * ) Notice: Subject to any disclaimer, the term of this patent is extended or adjusted under 35 U.S.C. 154(b) by 677 days.

(21) Appl. No.: 12/308,506

(22) PCT Filed: Jun. 14, 2007

(86) PCT No.: PCT/GB2007/002218

§ 371 (c)(1), (2), (4) Date: Dec. 7, 2009

(87) PCT Pub. No.: WO2007/148053

PCT Pub. Date: Dec. 27, 2007

(65) Prior Publication Data

US 2010/0235975 A1 Sep. 23, 2010

Related U.S. Application Data

(60) Provisional application No. 60/805,227, filed on Jun. 20, 2006, provisional application No. 60/939,390, filed on May 22, 2007.

(51) Int. Cl.

| | |
|---|---|
| ***E03D 9/02*** | (2006.01) |
| ***C11D 3/37*** | (2006.01) |
| ***C11D 7/32*** | (2006.01) |
| ***C11D 17/00*** | (2006.01) |

(52) U.S. Cl. ..... 510/191; 510/193; 510/440; 510/447; 510/475; 134/42

(58) Field of Classification Search ..... 510/191, 510/193, 440, 447, 475; 134/42
See application file for complete search history.

(56) References Cited

U.S. PATENT DOCUMENTS

| | | | | |
|---|---|---|---|---|
| 3,954,960 | A | 5/1976 | Valan | |
| 4,861,511 | A * | 8/1989 | Kaplan | 510/193 |
| 5,759,974 | A | 6/1998 | Menke et al. | |
| 2007/0155646 | A1 * | 7/2007 | Becker et al. | 510/499 |

FOREIGN PATENT DOCUMENTS

| | | | |
|---|---|---|---|
| EP | 311343 | * | 4/1989 |
| EP | 0311343 | A2 | 4/1989 |
| EP | 1156101 | A | 11/2001 |
| FR | 2077143 | A | 2/2009 |
| GB | 1331819 | A | 9/1973 |
| WO | 9847992 | A1 | 10/1998 |
| WO | 2006013318 | A | 2/2006 |
| WO | 2007068870 | A | 6/2007 |

OTHER PUBLICATIONS

International Preliminary Report on Patentability issued Dec. 22, 2008.

* cited by examiner

*Primary Examiner* — Brian P Mruk
(74) *Attorney, Agent, or Firm* — Norris McLaughlin & Marcus PA

(57) ABSTRACT

Improved treatment blocks useful in the treatment of lavatory appliances, particularly toilets are provided. The improved treatment blocks are solid block compositions which comprise at least one detersive surfactant, a film forming constituent, optionally a bleach constituent and one or more further optional constituents. The improved treatment blocks provide good detersive characteristics and further provide a film forming material which contacts the surfaces of the lavatory appliance, e.g., toilet, in which the block compositions are used. Methods of producing the solid block composition and treatment blocks therefrom, as well as methods of use are also disclosed.

5 Claims, 2 Drawing Sheets

SOLID TREATMENT BLOCKS FOR SANITARY APPLIANCES

This is an application filed under 35 USC 371 of PCT/GB2007/002218, which in turn claims priority of U.S. Provisional patent applications Ser. No. 60/805,227 filed Jun. 20, 2006 and Ser. No. 60/939,390 filed May 22, 2007.

The present invention relates to improved solid treatment block compositions useful for providing an active treatment composition to a sanitary appliance, e.g., a toilet or urinal. More particularly the present invention relates to improved solid treatment blocks which include a film forming constituent.

Solid treatment block have found widespread use in the cleaning and/or disinfecting treatment of sanitary appliances as, once installed they require little or no user intervention during their effective service life. Such solid treatment block compositions are considered to operate in an automatic fashion and their effective functioning is dependent in great part upon their composition, their dissolution characteristics when contacted with water and their placement within the sanitary appliance which they are used to treat. Typically such solid treatment block compositions are used in either one of two modes, either as an "ITC" or "in the cistern" mode, or as an "ITB" or "in the bowl" mode. In the former the solid treatment block composition is placed in water supply tank, also known as the cistern or toilet tank wherein it is expected to dissolve over a period of time and thus deliver active cleaning and/or disinfecting constituents to the water present in the cistern which is periodically used to flush the toilet bowl or other sanitary appliance, e.g., a urinal. Such a solid treatment block composition may be supplied to the interior of the cistern as a tablet or other self supporting shape, or alternately the solid treatment block composition may be provided in a container or cage, or as part of a dispensing device, from which the active cleaning and/or disinfecting constituents are delivered to the water present in the cistern. In the latter, the solid treatment block composition is placed within the bowl, typically supported by a device, cage, or even a simple bent wire such that the active cleaning and/or disinfecting constituents are contacted with water flushed into the sanitary appliance, especially the bowl of a toilet, or the interior of a urinal. In such an installation it is expected that a part of the solid treatment block composition is dissolved with each flush of water passing though the device such that an amount of active cleaning and/or disinfecting constituents are dispensed to the toilet bowl, urinal, etc.

The art is replete with many forms of solid treatment block compositions which find use either as ITB or ITC type compositions. Examples of such solid treatment block compositions include those described in the following: U.S. Pat. No. 4,246,129; U.S. Pat. No. 4,269,723; U.S. Pat. No. 4,043,931; U.S. Pat. No. 4,460,490; U.S. Pat. No. 4,722,802; U.S. Pat. No. 4,820,449; U.S. Pat. No. 5,342,550; U.S. Pat. No. 5,562,850; U.S. Pat. No. 5,711,920; U.S. Pat. No. 5,759,974; U.S. Pat. No. 5,939,372; U.S. Pat. No. 6,001,789 as well as U.S. Pat. No. 6,294,510. Each of these patents disclosed solid treatment block compositions which provide specific technical benefits, or overcome specific technical shortcomings which were hithero known to the art until the time of the respective invention. For example, various processing shortcomings are known from the manufacture of such blocks, or from the dissolution characteristics of such blocks as are described in these patents or which are otherwise known to the relevant art.

Thus, while these solid treatment block compositions are useful and provide certain advantageous features there is nonetheless a real and continuing need in the art for further solid treatment block compositions which are effective in the treatment of sanitary appliances both in an ITB and/or in an ITC mode. There also remains a real and urgent need in the art for such improved solid treatment block compositions which provide improved manufacturing effects, improved handling effects subsequent to the manufacture of such solid treatment block compositions, as well as improved block stability effects of such solid treatment block compositions particularly when used within a device such as in an ITB or ITC device installed in a toilet or other sanitary appliance.

Accordingly it is an object of the present invention to provide an improved solid treatment block composition useful as an ITB or ITC device installed in a toilet or other sanitary appliance. Such a solid treatment block composition operates to provide a cleaning and bleaching effect (preferably both cleaning and bleaching effect) to sanitary appliances within which they are used.

It is a further object of the invention to provide improved processes for the manufacture of the aforesaid solid treatment block compositions.

It is a yet further object of the invention which exhibits improved handling characteristics subsequent to the manufacture of the aforesaid solid treatment block compositions, especially prior to their use of solid blocks formed therefrom as an ITB or ITC device installed in a toilet or other sanitary appliance.

It is a still further object of the invention to provide an improved solid treatment block composition useful as or with an ITB or ITC device in the form of a solid, self-supporting block installed in a toilet or other sanitary appliance which exhibits good delivery characteristics and dimensional stability during their use.

It is a yet further object of the invention to provide an improved solid treatment block composition useful as or with an ITB or ITC device which block composition includes a film forming constituent.

These and other objects of the invention will become apparent to those of ordinary skill in this art from the following detailed description.

According to one aspect of the invention there is provided a treatment block formed from a solid block composition which includes at least: a surfactant constituent and a film forming constituent and one or more further optional constituents.

According to a second aspect of the invention there is provided a treatment block formed from a solid block composition which includes: a surfactant constituent, a bleach constituent, a film forming constituent, and optionally one or more further constituents.

In a further aspect of the invention there is provide an improved treatment block according to the first or second aspects of the invention as recited above which exhibits good delivery characteristics and dimensional stability during their use in providing a cleaning and/or disinfecting treatment of a lavatory appliance within which they are used, and which further releases a film forming constituent which forms a coating or film on the surfaces of a lavatory appliance.

In a yet further aspect of the invention there is provided an improved treatment block according to the first or second aspects of the invention as recited above which provide improved manufacturing characteristics particularly improved extrusion characteristics and/or improved handling characteristics of treatment blocks formed from the solid block composition subsequent to their manufacture but prior to their use in a sanitary appliance.

Figure 1:
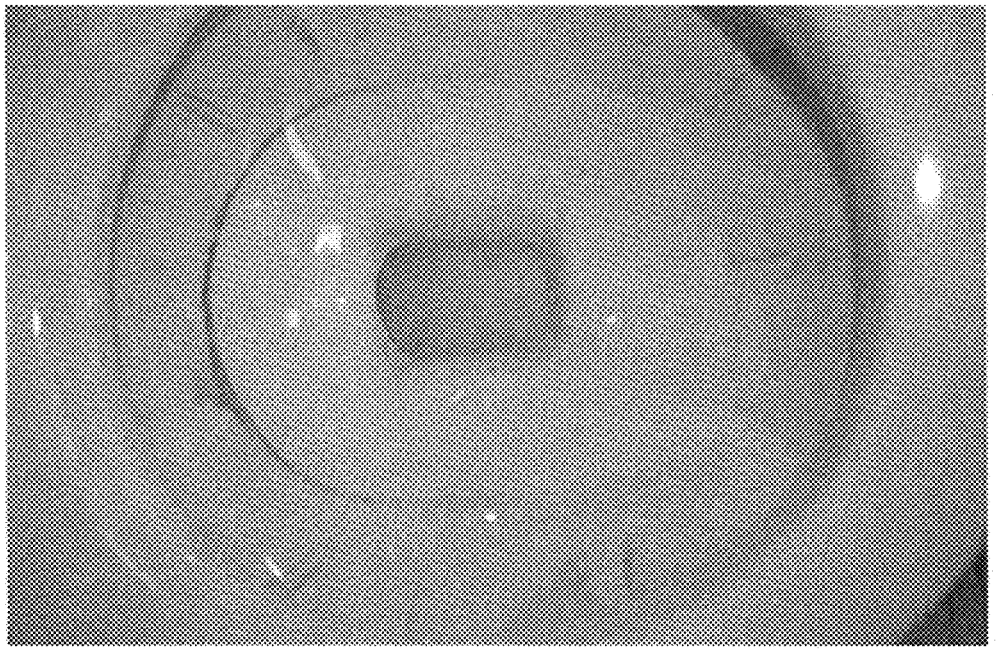
FIGS. 1 and 2 are photographs of the interior of a toilet bowl treated with an ITB block having a composition according to the present invention.

The solid block composition of the invention necessarily comprises a surfactant constituent which comprises one or more detersive surfactants. Exemplary useful surfactants include anionic, nonionic, cationic, amphoteric, and zwitterionic surfactants, particularly those whose melting points are sufficiently high, above about 110° F., preferably above 125° F., to permit processing according to known art techniques. However, small amounts of low melting point surfactants and even liquid surfactants may be used in providing the surfactant constituent.

Exemplary useful anionic surfactants which may be used in the solid block composition of the invention include one or more of alcohol sulfates and sulfonates, alcohol phosphates and phosphonates, alkyl ester sulfates, alkyl diphenyl ether sulfonates, alkyl sulfates, alkyl ether sulfates, sulfate esters of an alkylphenoxy polyoxyethylene ethanol, alkyl monoglyceride sulfates, alkyl sulfonates, alkyl ether sulfates, alpha-olefin sulfonates, beta-alkoxy alkane sulfonates, alkyl ether sulfonates, ethoxylated alkyl sulfonates, alkylaryl sulfonates, alkylaryl sulfates, alkyl monoglyceride sulfonates, alkyl carboxylates, alkyl ether carboxylates, alkyl alkoxy carboxylates having 1 to 5 moles of ethylene oxide, alkylpolyglycolethersulfates (containing up to 10 moles of ethylene oxide), sulfosuccinates, octoxynol or nonoxynol phosphates, taurates, fatty taurides, fatty acid amide polyoxyethylene sulfates, acyl glycerol sulfonates, fatty oleyl glycerol sulfates, alkyl phenol ethylene oxide ether sulfates, paraffin sulfonates, alkyl phosphates, isethionates, N-acyl taurates, alkyl succinamates and sulfosuccinates, alkylpolysaccharide sulfates, alkylpolyglucoside sulfates, alkyl polyethoxy carboxylates, and sarcosinates or mixtures thereof.

Further examples of anionic surfactants include water soluble salts or acids of the formula $(ROSO_3)_xM$ or $(RSO_3)_xM$ wherein R is preferably a $C_6$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a mono-, di- or tri-valent cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like) and x is an integer, preferably 1 to 3, most preferably 1.

Yet further examples of anionic surfactants include alkyldiphenyl-ethersulphonates and alkyl-carboxylates. Other anionic surfactants can include salts (including, for example, sodium, potassium, ammonium, and substituted ammonium salts such as mono-, di- and triethanolamine salts) of soap, $C_6$-$C_{20}$ linear alkylbenzenesulfonates, $C_6$-$C_{22}$ primary or secondary alkanesulfonates, $C_6$-$C_{24}$ olefinsulfonates, sulfonated polycarboxylic acids prepared by sulfonation of the pyrolyzed product of alkaline earth metal citrates, e.g., as described in British patent specification No. 1,082,179, $C_6$-$C_{24}$ alkylpolyglycolethersulfates (containing up to 10 moles of ethylene oxide); alkyl ester sulfates such as $C_{14-16}$ methyl ester sulfates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678 to Laughlin, et al. at column 23, line 58 through column 29, line 23, the contents of which are herein incorporated by reference.

A preferred class of anionic surfactants are linear alkyl benzene sulfonate surfactant wherein the alkyl portion contains 8 to 16 carbon atoms, and most preferably about 11 to 13 carbon atoms. According to particularly preferred embodiments of the invention, the solid block compositions necessarily include an anionic surfactant, especially linear alkyl benzene sulfonates containing 11, 12 or 13 carbon atoms, as well as salt forms thereof. The most preferred anionic surfactants are sodium alkylaryl sulfonates sold commercially by Albright & Wilson Warley, England under the trademarks NANSA, and UFARYL sold by Unger Fabrikker, Fredistad, Norway, either individually or in combination.

The detersive surfactant constituent of the solid block composition of the invention may include one or more nonionic surfactants. Practically any hydrophobic compound having a carboxy, hydroxy, amido, or amino group with a free hydrogen attached to the nitrogen can be condensed with an alkylene oxide, especially ethylene oxide or with the polyhydration product thereof, a polyalkylene glycol, especially polyethylene glycol, to form a water soluble or water dispersible nonionic surfactant compound. Further, the length of the polyethenoxy hydrophobic and hydrophilic elements may various. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

One class of useful nonionic surfactants include polyalkylene oxide condensates of alkyl phenols. These compounds include the condensation products of alkyl phenols having an alkyl group containing from about 6 to 12 carbon atoms in either a straight chain or branched chain configuration with an alkylene oxide, especially an ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

A further class of useful nonionic surfactants include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5, which is described in product literature from Sasol as a $C_8$-$C_{10}$ straight-chain alcohol having an average molecular weight of 356, an ethylene oxide content of about 4.85 moles (about 60 wt. %), and an HLB of about 12; Alfonic® 810-2, which is described in product literature as a $C_8$-$C_{10}$ straight-chain alcohols having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are $C_{10}$ oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol®ON 110). Other examples of ethoxylated alcohols include the Neodol® 91 series non-ionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants include primary and secondary linear and branched alcohol ethoxylates, such as those based on $C_6$-$C_{18}$ alcohols which further include an average of from 2 to 80 moles of ethoxylation per mol of alcohol. These examples include the Genapol® UD (ex. Clariant, Muttenz, Switzerland) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO.

Exemplary useful nonionic surfactants include the condensation products of a secondary aliphatic alcohols containing 8 to 18 carbon atoms in a straight or branched chain configuration condensed with 5 to 30 moles of ethylene oxide. Examples of commercially available nonionic detergents of the foregoing type are those presently commercially available under the trade name of Tergitol® such as Tergitol 15-S-12 which is described as being $C_{11}$-$C_{15}$ secondary alkanol condensed with 9 ethylene oxide units, or Tergitol 15-S-9 which is described as being $C_{11}$-$C_{15}$ secondary alkanol condensed with 12 ethylene oxide units per molecule.

A further class of useful nonionic surfactants include those surfactants having a formula:

$$RO(CH_2CH_2O)_nH$$

wherein;

R is a mixture of linear, even carbon-number hydrocarbon chains ranging from $C_{12}H_{25}$ to $C_{16}H_{33}$ and n represents the number of ethoxy repeating units and is a number of from about 1 to about 12.

Surfactants of this formula are presently marketed under the Genapol® tradename (ex. Clariant), which surfactants include the "26-L" series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3, 24-L-45, 24-L-50, 24-L-60, 24-L-60N, 24-L-75, 24-L-92, and 24-L-98N, all sold under the Genapol® tradename.

Further useful non-ionic surfactants which may be used in the inventive compositions include those presently marketed under the trade name Pluronics® (ex. BASF). The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals of the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics® L64.

Further nonionic surfactants which may be included in the inventive compositions include alkoxylated alkanolamides, preferably $C_8$-$C_{24}$ alkyl di($C_2$-$C_3$ alkanol amides), as represented by the following formula:

$$R_5—CO—NH—R_6—OH$$

wherein $R_5$ is a branched or straight chain $C_8$-$C_{24}$ alkyl radical, preferably a $C_{10}$-$C_{16}$ alkyl radical and more preferably a $C_{12}$-$C_{14}$ alkyl radical, and $R_6$ is a $C_1$-$C_4$ alkyl radical, preferably an ethyl radical.

According to certain particularly preferred embodiments the detersive surfactant constituent necessarily comprises a nonionic surfactant based on a linear primary alcohol ethoxylate particularly wherein the alkyl portion is a $C_8$ to $C_{16}$, but particularly a $C_9$ to $C_{11}$ alkyl group, and having an average of between about 6 to about 8 moles of ethoxylation.

One further useful class of nonionic surfactants include those in which the major portion of the molecule is made up of block polymeric $C_2$-$C_4$ alkylene oxides, with alkylene oxide blocks containing $C_3$ to $C_4$ alkylene oxides. Such nonionic surfactants, while preferably built up from an alkylene oxide chain starting group, can have as a starting nucleus almost any active hydrogen containing group including, without limitation, amides, phenols, and secondary alcohols.

One group of nonionic surfactants containing the characteristic alkylene oxide blocks are those which may be generally represented by the formula (A):

$$HO\text{-}(EO)_x(PO)_y(EO)_z\text{—}H \quad (A)$$

where EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants appropriate for use in the new compositions can be represented by the formula (B):

$$R\text{-}(EO,PO)_a(EO,PO)_b\text{—}H \quad (B)$$

wherein R is an alkyl, aryl or aralkyl group, the alkoxy group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO\text{—}(BO)_n(EO)_x\text{—}H \quad (C)$$

wherein R is an alkyl group containing 1 to 20 carbon atoms, n is about 15 and x is about 15.

Also useful as the nonionic block copolymer surfactants which also include polymeric butoxy groups are those which may be represented by the following formula (D):

$$HO\text{-}(EO)_x(BO)_n(EO)_y\text{—}H \quad (D)$$

wherein n is about 15, x is about 15 and y is about 15.

Still further useful nonionic block copolymer surfactants include ethoxylated derivatives of propoxylated ethylene diamine, which may be represented by the following formula:

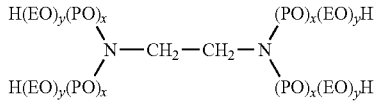

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Further useful nonionic surfactants include nonionic amine oxide constituent. Exemplary amine oxides include:

A) Alkyl di(lower alkyl) amine oxides in which the alkyl group has about 10-20, and preferably 12-16 carbon atoms, and can be straight or branched chain, saturated or unsaturated. The lower alkyl groups include between 1 and 7 carbon atoms. Examples include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

B) Alkyl di (hydroxy lower alkyl) amine oxides in which the alkyl group has about 10-20, and preferably 12-16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide;

C) Alkylamidopropyl di(lower alkyl) amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and D) Alkylmorpholine oxides in which the alkyl group has about 10-20, and preferably 12-16 carbon atoms, and can be straight or branched chain, saturated or unsaturated.

Preferably the amine oxide constituent is an alkyl di (lower alkyl) amine oxide as denoted above and which may be represented by the following structure:

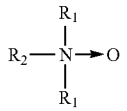

wherein each:

$R_1$ is a straight chained $C_1$-$C_4$ alkyl group, preferably both $R_1$ are methyl groups; and, $R_2$ is a straight chained $C_8$-$C_{18}$ alkyl group, preferably is $C_{10}$-$C_{14}$ alkyl group, most preferably is a $C_{12}$ alkyl group.

Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R_2$ group are present. Preferably, the amine oxides used in the present invention include $R_2$ groups which comprise at least 50% wt., preferably at least 60% wt. of $C_{12}$ alkyl groups and at least 25% wt. of $C_{14}$ alkyl groups, with not more than 15% wt. of $C_{16}$, $C_{18}$ or higher alkyl groups as the $R_2$ group.

Still further exemplary useful nonionic surfactants which may be used include certain alkanolamides including monoethanolamides and diethanolamides, particularly fatty monoalkanolamides and fatty dialkanolamides, e.g., lauryl monoethanolamide.

A cationic surfactant may be incorporated as a germicide or as a detersive surfactant in the solid block composition of the present invention, particularly wherein a bleach constituent is absent from the solid block composition. Cationic surfactants are per se, well known, and exemplary useful cationic surfactants may be one or more of those described for example in *McCutcheon's Functional Materials*, Vol. 2, 1998; *Kirk-Othmer, Encyclopedia of Chemical Technology,* 4th Ed., Vol. 23, pp. 481-541 (1997), the contents of which are herein incorporated by reference. These are also described in the respective product specifications and literature available from the suppliers of these cationic surfactants.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

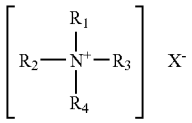

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

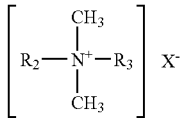

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include compositions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks, which are more fully described in, for example, *McCutcheon's Functional Materials* (Vol. 2), North American Edition, 1998, as well as the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in McCutcheon's as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (50% solution); HYAMINE® 3500 (50% actives), described as alkyl dimethyl benzyl ammonium chloride (also available as 80% active (HYAMINE® 3500-80)); and HYMAINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% acive); BTC® 776 is described to be myrisalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTU) 835 and BTC® 818 (50% active) (available also as 80% active (BTU) 888)); BTC® 1010 is described as didecyl dimethyl ammonium chloride (50% active) (also available as 80% active (BTC® 1010-80)); BTU) 2125 (or BTC® 2125 M) is described as alkyl dimethyl benzyl ammonium chloride and alkyl dimethyl ethylbenzyl ammonium chloride (each 50% active) (also available as 80% active (BTC® 2125 80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE® are presently commercially available from Stepan Company, Northfield, Ill.) Polymeric quaternary ammonium salts based on these monomeric structures are also considered desirable for the present invention. One example is POLYQUAT®, described as being a 2-butenyldimethyl ammonium chloride polymer.

When present in a solid block composition, it is preferred that the germicidal cationic surfactant(s) are present in amounts so to dispense at least about 200-500 parts per million (ppm) in the water flushed into the sanitary appliance, e.g., toilet bowl, or into the water retained in the sanitary appliance at the conclusion of the flush cycle.

Further detersive surfactants which may be included are amphoteric and zwitterionic surfactants which provide a detersive effect. Exemplary useful amphoteric surfactants include alkylbetaines, particularly those which may be represented by the following structural formula:

$$RN^{+}(CH_3)_2CH_2COO^{-}$$

wherein R is a straight or branched hydrocarbon chain which may include an aryl moiety, but is preferably a straight hydrocarbon chain containing from about 6 to 30 carbon atoms. Further exemplary useful amphoteric surfactants include amidoalkylbetaines, such as amidopropylbetaines which may be represented by the following structural formula:

$$RCONHCH_2CH_2CH_2N^{+}(CH_3)_2CH_2COO^{-}$$

wherein R is a straight or branched hydrocarbon chain which may include an aryl moiety, but is preferably a straight hydrocarbon chain containing from about 6 to 30 carbon atoms.

As noted above, preferred detersive surfactants are those which exhibit a melting points above about 110° F., preferably above 125° F., in order to permit convenient processing according to known art techniques. Nonetheless small amounts of low melting point surfactants, i.e., those exhibiting melting points below about 110° F. and even liquid surfactants may be used in providing the surfactant constituent of the solid block composition.

As the performance requirements of treatment blocks may differ according to their use as either an ITB or as an ITC block, the amounts of the constituents present in the block may vary as well depending upon the final intended use of the treatment block.

When intended for use as an ITB block, the detersive surfactant constituent may be present in any effective amount and generally comprises up to about 95% wt. of the total weight of the solid block composition, and the resultant treatment block formed therefrom. Preferably the detersive surfactant constituent comprises about 20-90% wt., more preferably 35-80% wt. of the solid block composition, and when used as an ITB block the detersive surfactant constituent most preferably comprises about 50-75% wt. of the solid block composition, and the resultant treatment block formed therefrom. When intended for use as an ITC block, the detersive surfactant constituent may be present in any effective amount and generally comprises up to about 60% wt. of the total weight of the solid block composition, and the resultant treatment block formed therefrom. Preferably the detersive surfactant constituent comprises about 10-55% wt., more preferably 20-50% wt. of the solid block composition, and the resultant treatment block formed therefrom. When used as an ITB block, the solid block composition is typically provided in a holder or cage which is used to retain the solid block composition within a toilet bowl, bidet or other sanitary appliance such that during a flush cycle, wherein water is flushed into said toilet bowl, bidet or other sanitary appliance the flush water comes into contact with the solid block composition and dissolves at least a part thereof in order to form a treatment composition which is used to treat the interior surfaces of the toilet bowl, bidet or other sanitary appliance in which the ITB block composition is found. Such holders or cages are well known to the art, and typically include a holder part which includes one or more passages therethrough in order to permit for the ingress, and egress of flush water which holder part retains the solid block composition, and further such holders or cages include a hanger part which is used to suspend or position the holder part in the path of flush water, such as may be attained by using the hanger part to suspend the holder part beneath the rim of a toilet bowl and in the path of flush water. When the solid block composition are adapted for use as an ITC block, the use of a cage or holder may not be essential as the solid block composition may conveniently used as a cake or block which can be placed at the bottom of a cistern or tank used to supply flush water to a toilet, bidet or other sanitary appliance. Alternately an ITC device may include a cage or holder which may be used to contain the solid block composition, which cage or holder may be used to suspend the solid block composition within the interior of a cistern or tank used to supply flush water to a toilet, bidet or other sanitary appliance. Such a cage or holder for an ITC device may be similar in many regards to the cage or holder of an ITB device, and such cage or holder for an ITC device are also widely known in the art.

The solid treatment blocks of the invention necessarily include a film forming constituent, viz., a film forming polymer in an effective amount. The use of film forming constituent is believed to provide for a reduction in limescale deposition on the treated hard surfaces, as the film forming constituent is provided with each flush or wash of water passing around the treatment block. It is believed that the long term buildup of limescale may be resisted or retarded on hard surfaces, viz., lavatory surfaces and lavatory appliances due to the presence of the film-forming constituent thereon. While it is preferred that the film forming constituent deposit a generally continuous film on a hard surface, it is to be understood that while the film forming constituent need be present in the present inventive compositions it is not required that any layer or film formed therefrom which is formed on the surface of a lavatory appliance, e.g., toilet bowl, be necessarily uniform either in thickness or be a continuous film providing uninterrupted surface coverage although such would be preferred. Rather it is contemplated that film forming materials useful in the present invention need not form a continuous or uniform coating, as it is only required that the film forming materials provide some extent of a surface coating to a hard surface upon which it is applied. It is to be understood that the potential for forming the film layer from a film forming composition is influenced by several factors, inter alia, the nature of the hard surface being treated, the geometry and configuration of the hard surface being treated, the fluid dynamics of the water contacting the treatment block, the quality of the water contacting the treatment block.

The film-forming constituent may be present in any amount which is found effective in forming a film on a hard surface being treated. It will be understood that this such a minimum amount will vary widely, and is in part dependent upon the molecular weight of the film forming polymer utilized in a formulation, but desirably at least about 0.001% wt. should be present. More preferably the film forming polymer comprises from 0.001% wt. to 10% wt. of the compositions of which it forms a part. The identity of particularly preferred film-forming polymers and preferred amounts are disclosed in one or more of the following examples.

Exemplary materials useful in the film forming constituent include film forming polymers such as:

a polymer having the formula

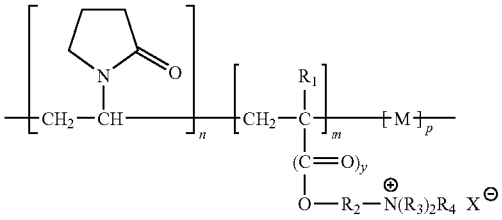

in which n represents from 20 to 99 and preferably from 40 to 90 mol %, m represents from 1 to 80 and preferably from 5 to 40 mol %; p represents 0 to 50 mol, (n+m+p=100); $R_1$ represents H or $CH_3$; y represents 0 or 1; $R_2$ represents —$CH_2$—CHOH—$CH_2$— $C_xH_{2x}$ in which x is 2 to 18; $R_3$ represents $CH_3$, $C_2H_5$ or t-butyl; $R_4$ represents $CH_3$, $C_2H_5$ or benzyl; X represents Cl, Br, I, 1/2$SO_4$, $HSO_4$ and $CH_3SO_3$; and M is a vinyl or vinylidene monomer copolymerisable with vinyl pyrrolidone other than the monomer identified in $[\ ]_m$;

quaternized copolymers of vinylpyrrolidone and dimethylaminoethyl methacrylate;

polyvinylpyrrolidone;

vinylpyrrolidone/vinylacetate;

vinylpyrrolidone/vinyl caprolactam/ammonium derivative terpolymer, especially where the ammonium derivative monomer has 6 to 12 carbon atoms and is selected from diallylamino alkyl methacrylamides, dialkyl dialkenyl ammonium halides, and a dialkylamino alkyl methacrylate or acrylate;

high molecular weight polyethylene glycol;

water soluble polyethylene oxide;

polyvinylcaprolactam;

polyvinylalcohol;

cationic cellulose polymer;

cationic fatty quaternary ammonium compounds;

organosilicone quaternary ammonium compounds;

2-propenamide, N-[3-(dimethylamino)propyl]-2-methyl, polymer with 1-ethenyl-2-pyrrolidone hydrochloride;

polynitrogen compounds, including amphoteric polyamide polymers; and, maleic acid/polyolefin copolymers;

one or more of which may be present in effective amounts.

A first film-forming polymer contemplated to be useful in the present compositions is one having the formula

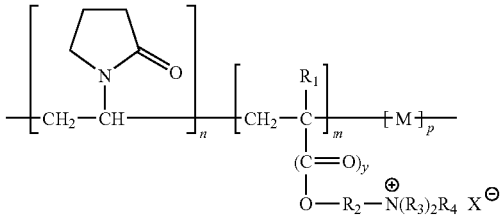

are more fully described in U.S. Pat. No. 4,445,521, U.S. Pat. No. 4,165,367, U.S. Pat. No. 4,223,009, U.S. Pat. No. 3,954,960, as well as GB 1,331,819, the contents of which are hereby incorporated by reference.

The monomer unit within $[\ ]_m$ is, for example, a di-lower alkylamine alkyl acrylate or methacrylate or a vinyl ether derivative. Examples of these monomers include dimethylaminomethyl acrylate, dimethylaminomethyl methacrylate, diethylaminomethyl acrylate, diethylaminomethyl methacrylate, dimethylaminoethyl acrylate, dimethylaminoethyl methacrylate, dimethylaminobutyl acrylate, dimethylaminobutyl methacrylate, dimethylaminoamyl methacrylate, diethylaminoamyl methacrylate, dimethylaminohexyl acrylate, diethylaminohexyl methacrylate, dimethylaminooctyl acrylate, dimethylaminooctyl methacrylate, diethylaminooctyl acrylate, diethylaminooctyl methacrylate, dimethylaminodecyl methacrylate, dimethylaminododecyl methacrylate, diethylaminolauryl acrylate, diethylaminolauryl methacrylate, dimethylaminostearyl acrylate, dimethylaminostearyl methacrylate, diethylaminostearyl acrylate, diethylaminostearyl methacrylate, di-t-butylaminoethyl methacrylate, di-t-butylaminoethyl acrylate, and dimethylamino vinyl ether.

Monomer M, which can be optional (p is up to 50) can comprise any conventional vinyl monomer copolymerizable with N-vinyl pyrrolidone. Thus, for example, suitable conventional vinyl monomers include the alkyl vinyl ethers, e.g., methyl vinyl ether, ethyl vinyl ether, octyl vinyl ether, etc.; acrylic and methacrylic acid and esters thereof, e.g., methacrylate, methyl methacrylate, etc.; vinyl aromatic monomers, e.g., styrene, a-methyl styrene, etc; vinyl acetate; vinyl alcohol; vinylidene chloride; acrylonitrile and substituted derivatives thereof; methacrylonitrile and substituted derivatives thereof; acrylamide and methacrylamide and N-substituted derivatives thereof; vinyl chloride, crotonic acid and esters thereof; etc. Again, it is noted that such optional copolymerizable vinyl monomer can comprise any conventional vinyl monomer copolymerizable with N-vinyl pyrrolidone. These film-forming polymers of the present invention are generally provided as a technical grade mixture which includes the polymer dispersed in an aqueous or aqueous/alcoholic carrier. Such include materials which are presently commercially available include quaternized copolymers of vinylpyrrolidone and dimethylaminoethyl methacrylate sold as Gafquat® copolymers (ex. ISP Corp., Wayne, N.J.) which are available in a variety of molecular weights.

Further exemplary useful examples of the film-forming polymers of the present invention include quaternized copolymers of vinylpyrrolidone and dimethylaminoethyl methacrylate as described in U.S. Pat. No. 4,080,310, to Ng, the contents of which are herein incorporated by reference.

Such quaternized copolymers include those according to the general formula:

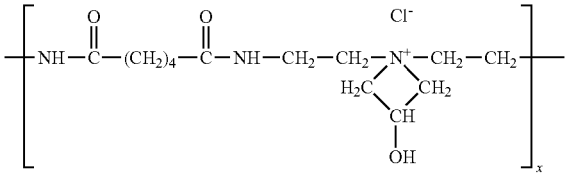

wherein "x" is about 40 to 60. Further exemplary useful copolymers include copolymers of vinylpyrrolidone and dimethylaminoethylmethacrylate quaternized with diethyl sulphate (available as Gafquat® 755 ex., ISP Corp., Wayne, N.J.).

Such a further useful film-forming polymer according to the invention is a quaternized polyvinylpyrrolidone/dimethylaminoethylmethacrylate copolymer which is commercially available as Gafquat® 734, is disclosed by its manufacturer to be:

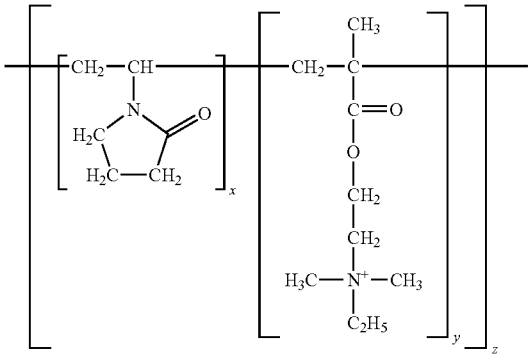

wherein x, y and z are at least 1 and have values selected such that the total molecular weight of the quaternized polyvinylpyrrolidone/dimethylamino ethylmethacrylate copolymer is at least 10,000 more desirably has an average molecular weight of 50,000 and most desirably exhibits an average molecular weight of 100,000. A further useful, but less preferred quaternized polyvinylpyrrolidone/dimethylamino ethylmethacrylate copolymer is available as Gafquat® 755N which is similar to the Gafquat® 734 material describe above but has an average molecular weight of about 1,000,000. These materials are sometimes referred to as "Polyquaternium-11".

Exemplary polyvinylpyrrolidone polymers useful in the present inventive compositions exhibit a molecular weight of at least about 5,000, with a preferred molecular weight of from about 6,000-3,000,000.

Such polyvinylpyrrolidone polymers are generally provided as a technical grade mixture of polyvinylpyrrolidone polymers within approximate molecular weight ranges. Exemplary useful polyvinylpyrrolidone polymers are available in the PVP line materials (ex. ISP Corp.) which include PVP K 15 polyvinylpyrrolidone described as having molecular weight in the range of from 6,000-15,000; PVP-K 30 polyvinylpyrrolidone with a molecular weight in the range of 40,000-80,000; PVP-K 60 polyvinylpyrrolidone with a molecular weight in the range of 240,000-450,000; PVP-K 90 polyvinylpyrrolidone with a molecular weight in the range of 900,000-1,500,000; PVP-K 120 polyvinylpyrrolidone with a molecular weight in the range of 2,000,000-3,000,000.

Other suppliers of polyvinylpyrrolidone include AllChem Industries Inc, Gainesville, Fla., Kraft Chemical Co., Melrose Park, Ill., Alfa Aesar, a Johnson Matthey Co., Ward Hill, Mass., and Monomer-Polymer & Dajac Labs Inc., Feasterville, Pa.

Exemplary vinylpyrrolidone/vinylacetate copolymers which find use in the present inventive compositions as the film forming constituent vinylpyrrolidone/vinylacetate copolymers comprised of vinylpyrrolidone monomers which may be represented by the following structural formula:

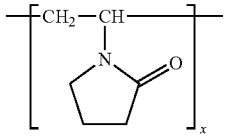

and vinylacetate monomers which may be represented by the following structural formula:

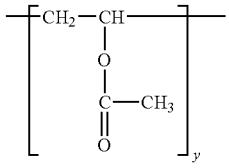

which are usually formed by a free-radical polymerization reaction to produce linear random vinylpyrrolidone/vinylacetate copolymers. The resultant vinylpyrrolidone/vinylacetate copolymers may comprise varying amounts of the individual vinylpyrrolidone monomers and vinylacetate monomers, with ratios of vinylpyrrolidone monomer to vinylacetate monomers from 30/70 to 70/30. The values of x and y in the structural formula should have values such that x+y=100 to 500, preferably x+y=150 to 300. Such values correspond to provide vinylpyrrolidone/vinylacetate copolymers having a total molecular weight in the range from about 10,000 to about 100,000, preferably from about 12,000 to about 60,000. Alternately, desirably the ratio of x:y is 0.1:4.0, preferably from 0.2:3.0. Such ratios of x:y provide the preferred vinylpyrrolidone/vinylacetate copolymers which have vinylpyrrolidone monomer to vinylacetate monomers from 0.3/2.5.

Exemplary useful vinylpyrrolidone/vinylcaprolactam/ammonium derivative terpolymers useful as the film forming constituent are comprised of vinylpyrrolidone monomers which may be represented by the following structural formula:

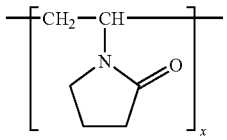

and vinylcaprolactam monomers which may be represented by the following structural formula:

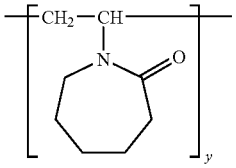

and dimethylaminoethylmethacrylate monomers which may be represented by the following structural formula:

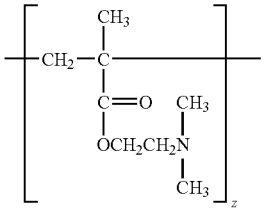

Exemplary vinylpyrrolidone/vinylcaprolactam/ammonium derivative terpolymer wherein the ammonium derivative monomer has 6 to 12 carbon atoms and is selected from diallylamino alkyl methacrylamides, dialkyl dialkenyl ammonium halides, and a dialkylamino alkyl methacrylate or acrylate which find use in the present inventive compositions include those marketed under the tradename ADVANTAGE® (ex. ISP.) as well as GAFFIX® (ex. ISP Corp). Such terpolymers are usually formed by a free-radical polymerization reaction to produce linear random vinylpyrrolidone/vinylcaprolactam/ammonium derivative terpolymers. The vinylpyrrolidone/vinylcaprolactam/ammonium derivative terpolymers useful in the present invention preferably comprise 17-32 weight % vinylpyrrolidone; 65-80 weight % vinylcaprolactam; 3-6 weight % ammonium derivative and 0-5 weight % stearyl methacrylate monomers. The polymers can be in the form of random, block or alternating structure having number average molecular weights ranging between about 20,000 and about 700,000; preferably between about 25,000 and about 500,000. The ammonium derivative monomer preferably has from 6 to 12 carbon atoms and is selected from the group consisting of dialkylaminoalkyl methacrylamide, dialkyl dialkenyl ammonium halide and a dialkylamino alkyl methacrylate or acrylate. Examples of the ammonium derivative monomer include, for example, dimethylamino propyl methacrylamide, dimethyl diallyl ammonium chloride, and dimethylamino ethyl methacrylate (DMAEMA). These terpolymers are more fully described in U.S. Pat. No. 4,521,404 to GAF Corporation, the contents of which are hereby incorporated by reference.

High molecular weight polyethylene glycol polymers useful in the present inventive compositions exhibit a molecular weight of at least about 100, preferably exhibits a molecular weight in the range of from about 100 to about 10,000 but most preferably a molecular weight in the range of from about 2000 to about 10,000. Particularly useful high molecular weight polyethylene glycols are available under the tradename CARBOWAX® (ex. Union Carbide Corp.). Other suppliers of high molecular weight polyethylene glycols include Ashland Chemical Co., BASF Corp., Norman, Fox & Co., and Shearwater Polymers, Inc.

Water soluble polyethylene oxides suitable for use as film forming polymers in the compositions according to the invention may be represented by the following structure:

$$(CH_2CH_2O)_x$$

where:

x has a value of from about 2000 to about 180,000.

Desirably, these polyethylene oxides may be further characterized as water soluble or water dispersible resins, having a molecular weight in the range of from about 100,000 to about 8,000,000. At room temperature (68° F., 20° C.) they are solids. Particularly useful as the film-forming, water soluble polyethylene oxide in the inventive compositions are POLYOX water-soluble resins (ex. Union Carbide Corp., Danbury Conn.).

Further contemplated as useful in the place of, or in combination with these polyethylene oxides are polypropylene oxides, or mixed polyethylene oxides-polypropylene oxides having molecular weights in excess of about 50,000 and if present, desirably having molecular weights in the range of from about 100,000 to about 8,000,000. According to particularly desirable embodiments of the invention, the film-forming constituent of the present invention is solely a water soluble polyethylene oxide.

Exemplary film-forming polyvinylcaprolactams include polyvinylcaprolactam compounds marketed under the tradename LUVISKOL® (ex. BASF Corp.). Such polyvinylcaprolactams may be represented by the following structural formula:

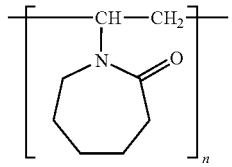

Where n has a value of at least about 500, and preferably a value in the range of from about 800 to about 1000.

Useful as the film forming constituent in the present inventive compositions are polyvinylalcohols which include those marketed under the tradename Airvol® (Air Products Inc., Allentown Pa.). These include: Airvol® 125, classified as a "super hydrolyzed" polyvinylalcohol polymer having a degree of hydrolysis of at least 99.3%, and a viscosity at a 4% solution in 20° C. water of from 28-32 cps; Airvol® 165, and Airvol® 165S, each being classified as "super hydrolyzed" polyvinylalcohol polymer having a degree of hydrolysis of at least 99.3%, and a viscosity at a 4% solution in 20° C. water of from 62-72 cps; Airvol® 103, classified as a "fully hydrolyzed" polyvinylalcohol polymer having a degree of hydrolysis of from 98.0-98.8%, and a viscosity at a 4% solution in 20° C. water of from 3.5-4.5 cps; Airvol® 305, classified as a "fully hydrolyzed" polyvinylalcohol polymer having a degree of hydrolysis of from 98.0-98.8%, and a viscosity at a 4% solution in 20° C. water of from 4.5-5.5 cps; Airvol® 107, classified as a "fully hydrolyzed" polyvinylalcohol polymer having a degree of hydrolysis of from 98.0-98.8%, and a viscosity at a 4% solution in 20° C. water of from 5.5-6.6 cps; Airvol® 321, classified as a "fully hydrolyzed" polyvinylalcohol polymer having a degree of hydrolysis of from 98.0-98.8%, and a viscosity at a 4% solution in 20° C. water of from 16.5-20.5 cps; Airvol® 325, classified as a "fully hydrolyzed" polyvinylalcohol polymer having a degree of hydrolysis of from 98.0-98.8%, and a viscosity at a 4% solution in 20° C. water of from 28-32 cps; and Airvol®350, classified as a "fully hydrolyzed" polyvinylalcohol polymer having a degree of hydrolysis of from 98.0-98.8%, and a viscosity at a 4% solution in 20° C. water of from 62-72 cps; Airvol® 425, classified as being an "intermediate hydrolyzed" polyvinylalcohol polymer classified having a degree of hydrolysis of from 95.5-96.5%, and a viscosity at a 4% solution in 20° C. water of from 27-31 cps; Airvol® 502, classified as a "partially hydrolyzed" polyvinylalcohol polymer having a degree of hydrolysis of from 87.0-89.0%, and a viscosity at a 4% solution in 20° C. water of from 3.0-3.7 cps; Airvol® 203 and Airvol® 203S, each classified as a "partially hydrolyzed" polyvinylalcohol polymer having a degree of hydrolysis of from 87.0-89.0%, and a viscosity at a 4% solution in 20° C. water of from 3.5-4.5 cps; Airvol® 205 and Airvol® 205S, each classified as a "partially hydrolyzed" polyvinylalcohol polymer having a degree of hydrolysis of from 87.0-89.0%, and a viscosity at a 4% solution in 20° C. water of from 5.2-6.2 cps; Airvol® 523, classified as a "partially hydrolyzed" polyvinylalcohol polymer having a degree of hydrolysis of from 87.0-89.0%, and a viscosity at a 4% solution in 20° C. water of from 23-27 cps; and Airvol® 540, each classified as a "partially hydrolyzed" polyvinylalcohol polymer having a degree of hydrolysis of from 87.0-89.0%, and a viscosity at a 4% solution in 20° C. water of from 45-55 cps. Of these, particularly preferred are polyvinyl alcohol polymers which exhibit a degree of hydrolysis in the range of from 87%-98% and which desirably also exhibit a viscosity at a 4% solution in 20° C. water of from 3.0-100.0 cps.

Exemplary cationic cellulose polymers which find use in the present inventive compositions as the film forming constituent include those described in U.S. Pat. No. 5,830,438 as being a copolymer of cellulose or of a cellulose derivative grafted with a water-soluble monomer in the form of quaternary ammonium salt, for example, halide (e.g., chloride, bromide, iodide), sulfate and sulfonate. Such polymers are described in U.S. Pat. No. 4,131,576 to National Starch & Chemical Company, the contents of which are hereby hydroxyethyl- and hydroxypropylcelluloses grafted with a salt of methacryloylethyltrimethyl ammonium, methacrylamidopropyltrimethyl ammonium, or dialkyldiallyl ammonium, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like. The preferred materials can be purchased for example under the trademarks "Celquat L 200" and "Celquat H 100" from National Starch & Chemical Company.

Useful cationic cellulose polymers are, per se, generally known. Exemplary cationic cellulose polymers useful in the present inventive compositions exhibit generally a viscosity of at least about 1,000 cps (as taken from a product specification of Celquat H-100; measured as 2% solids in water using an RVF Brookfield Viscometer, #2 spindle at 20 rpm and 21° C.).

A further class of materials which find use in the film forming constituent are film forming cationic polymers, an especially film-forming fatty quaternary ammonium compounds which generally conform to the following structure:

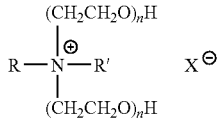

wherein R is a fatty alkyl chain, e.g., $C_8$-$C_{32}$ alkyl chain such as tallow, coco, stearyl, etc., R' is a lower $C_1$-$C_6$ alkyl or alkylene group, the sum of both n is between 12-48, and X is a salt-forming counterion which renders the compound water soluble or water dispersible, e.g., an alkali, alkaline earth metal, ammonium, methosulfate as well as $C_1$-$C_4$ alkyl sulfates. Of these, a preferred film forming film-forming fatty quaternary ammonium compound may be represented by the following structure:

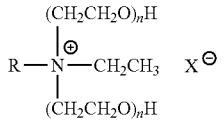

wherein R is a fatty alkyl chain, e.g., $C_8$-$C_{32}$ alkyl chain such as tallow, coco, stearyl, etc., the sum of both "n" is between 12-48, and preferably the value of each n is the same as the other, and X is a salt-forming counterion such as an alkali, alkaline earth metal, ammonium, methosulfate but is preferably an alkyl sulfate such as ethyl sulfate but especially diethyl sulfate. An preferred example of a commercially available material which may be advantageously used is CRODAQUAT TES (ex. Croda Inc., Parsippany, N.J.) described to be polyoxyethylene (16) tallow ethylammonioum ethosfulfate. A further preferred commercially available material is CRODAQUAT 1207 (ex. Croda Inc.)

A further class of particularly useful film forming materials include film-forming, organosilicone quaternary ammonium compounds. Such compounds may also exhibit antimicrobial activity, especially on hard surfaces which may supplement the effect of the quaternary ammonium surfactant compounds having germicidal properties.

Specific examples of organosilicone quaternary ammonium salts that may be used in the compositions of this invention include organosilicone derivatives of the following ammonium salts: di-isobutylcresoxyethoxyethyl dimethyl benzyl ammonium chloride, di-isobutylphenoxyethoxyethyl dimethyl benzyl ammonium chloride, myristyl dimethylbenzyl ammonium chloride, myristyl picolinium chloride, N-ethyl morpholinium chloride, laurylisoquinolinium bromide, alkyl imidazolinium chloride, benzalkonium chloride, cetyl pyridinium chloride, coconut dimethyl benzyl ammonium chloride, stearyl dimethyl benzyl ammonium chloride, alkyl dimethyl benzyl ammonium chloride, alkyl diethyl benzyl ammonium chloride, alkyl dimethyl benzyl ammonium bromide, di-isobutyl phenoxyethoxyethyl trimethyl ammonium chloride, di-isobutylphenoxyethoxyethyl dimethyl alkyl ammonium chloride, methyl-dodecylbenzyl trimethyl ammonium chloride, cetyl trimethyl ammonium bromide, octadecyl dimethyl ethyl ammonium bromide, cetyl dimethyl ethyl ammonium bromide, octadec-9-enyl dimethyl ethyl ammonium bromide, dioctyl dimethyl ammonium chloride, dodecyl trimethyl ammonium chloride, octadecyl trimethyl ammonium chloride, octadecyl trimethyl ammonium bromide, hexadecyl trimethyl ammonium iodide, octyl trimethyl ammonium fluoride, and mixtures thereof. Other water dispersible salts, such as the acetates, sulfates, nitrates, and phosphates, are effective in place of the halides, but the chlorides and bromides are preferred. The silicone group is preferably substituted with alkyl ethers. Preferred alkyl ethers are short carbon chain ethers such as methoxy and ethoxy substituents.

Still further examples of particularly preferred film-forming, organosilicone quaternary ammonium compounds which find use in the present inventive compositions include those which may be represented by the following structural representation:

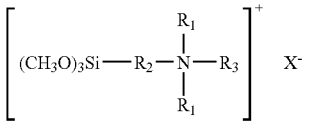

wherein:

$R_1$ and $R_2$ each independently represent short chain alkyl or alkenyl groups, preferably $C_1$-$C_8$ alkyl or alkenyl groups;

$R_3$ represents a $C_{11}$-$C_{22}$ alkyl group; and

X represents a salt forming counterion, especially a halogen.

Preferred short chain alkyl substituents for $R_1$ are methyl and ethyl, preferred short chain alkyl substituents for $R_2$ are straight chain links of methylene groups consisting of from 1 to 4 members, preferred $R_3$ substituents are straight chain links of methylene groups consisting of from 11 to 22 members, and preferred halogens for X are chloride and bromide.

Exemplary and preferred film-forming, organosilicone quaternary ammonium compounds useful in the inventive compositions is AEM® 5772 or AEM® 5700 (from Aegis Environmental Co., Midland, Mich.). Both of these materials are described as being 3-(trimethoxysilyl)propyloctadecyldimethyl ammonium chloride, AEM® 5700 and is sold as a 72% by weight active solution of the compound in a water/methanol mixture, while AEM® 5772 is sold as a 72% by weight active solution of the compound in a water/methanol mixture. While the film-forming, organosilicone quaternary ammonium compound may be present in any effective amount, desirably it is present in amounts of from 0.01-5% wt., more desirably from 0.05-2.5% wt. based on the total weight of the inventive compositions.

As further materials useful in as the film forming polymers in the present invention includes materials currently being sold under the VIVIPRINT tradename, e.g., VIVIPRINT 131, which is described to be 2-propenamide, N-[3-(dimethylamino)propyl]-2-methyl, polymer with 1-ethenyl-2-pyrrolidone hydrochloride.

One particularly preferred class of materials useful as the film forming constituent of the present invention are polynitrogen compounds, especially amphoteric polyimide polymers.

Organic polynitrogen compound in the sense of the present invention means an organic compound comprising at least 3 nitrogen atoms which are contained in the molecule in the form of an amine, like a primary, a secondary or a teriary amine, and/or in the form of an amide. By amphoteric is meant that the same compound may function as acceptor as well as a donator for protons.

Exemplary suitable functional groups imparting proton donator properties represent carboxy residues or derivatives thereof, like amides, anhydrides or esters, as well as salts thereof, like alkali salts, for example sodium or potassium salts, or ammonium salts, which may be converted into the carboxy group. Depending on the size of the polynitrogen moiety there may be one or more proton donating functionalities in the molecule. It is preferred that more than one proton donating functionalities are present in the amphoteric polynitrogen compound.

Preferred amphoteric organic polynitrogen compounds are polymeric amphoteric organic polynitrogen-compounds, having an average molecular weight of at least about 200, preferably at least about 300, 400, 500, 600, 700, 800, 900, 1000 or even greater.

The one or more amphoteric organic polynitrogen compounds preferably are independently obtainable from reacting polyalkylene polyamines, polyamidoamines, ethyleneimine-grafted polyami-doamides, polyetheramines or mixtures thereof as component A optionally with at least bi-functional cross-linking agents having a functional group independently selected from a halohydrin, a glycidyl, an aziridine or an isocyanate moiety or a halogen atom, as component B, and with monoethylenically unsaturated carboxylic acids; salts, esters, amides or nitriles of monoethylenically unsaturated carboxylic acids; salts, esters, amides or nitriles of monoethylenically unsaturated carboxylic acids, chlorocarboxylic acids and/or glycidyl compounds such as glycidyl acid, glycidyl amide or glycidyl esters. Such compounds are described for example in WO 2005/073357 A2, the contents of which are herein incorporated by reference.

The amphoteric organic polynitrogen compounds are obtainable by reacting components A, optionally with B and with C. The compound therefore can be present in cross-linked or uncross-linked form, wherein component A in any case is modified with component C. Components A, optionally B and C may be used in any possible ratio. If component B is employed, preferably components A and B are used in a molar ratio of from 100:1 to 1:1000, more preferred of from 20:1 to 1:20. The molar ratio of components A and C preferably is chosen such that the molar ratio of the hydrogen atoms bonded to the nitrogen in A and component C is from 1:0.2 to 1:0.95, more preferred from 1:0.3 to 1:0.9, and even more preferred from 1:0.4 to 1:0.85.

Exemplary suitable compounds useful as component A include polyalkylene polyamines, which are to be understood as referring to compounds comprising at least 3 nitrogen atoms, including but not limited to: diethylenetriamine, triethylenetetraamine, tetraethylenepentaamine, pentaethylenehexamine, diaminopropylenediamine, trisaminopropylamine and polyethyleneimine. Polyethyleneimines preferably have an average molecular weight (Mw) of at least 300. It is particularly preferred that the average molecular weight of the poyethyleneimines ranges from about 600 to about 2,000,000, more preferred from 20,000 to 1,000,000, and even more preferred from 20,000 to 750,000, as may be determined by means of light scattering. The polyethyleneimines may be partially amidated, and such may be obtained by reacting polyalkylene polyamines with carboxylic acids, carboxylic acid esters, carboxylic acid anhydrides or acylhalides. The polyalkylene polyamines as suitable in the present invention preferably are amidated to an extent of 1 to 30, more preferred of up to 20% for the subsequent reactions. The amidated polyalkylene polyamines are required to contain free NH-groups in order to let them react with compounds B and C. Suitable carboxylic acids which may be used to amidate the polyalkylene polyamines are exemplified by $C_1$-$C_{28}$ carboxylic acids, including but not limited to formic acid, acetic acid, propionic acid, benzoic acid, lauric acid, palmitic acid, stearic acid, oleic acid, linoleic acid and behenic acid.

Alternately the polyethyleneimines may be partially amidated by reacting the polyalkylene polyamine with alkyldiketene.

The polyalkylene polyamines may be used partly in quaternized form as component A. Suitable quaternization agents include, for example, alkyl halides, such as methyl chloride, ethyl chloride, butyl chloride, epichlorohydrin, hexyl chloride, dimethyl sulfate, diethyl sulfate and benzyl chloride. If quaternized polyalkyleneamines are used as component A, the degree of quaternization preferably is 1 to 30.

Further compounds which may also be used as component A included polyamidoamines. Polyamidoamines are obtainable, for example, by reacting $C_4$-$C_{10}$ dicarboxylic acids with polyalkylene polyamines containing preferably 3 to 10 alkaline nitrogen atoms. Suitable dicarboxylic acids can be exemplified by succinic acid, maleic acid, adipic acid, glutaric acid, suberic acid, sebacic acid and terephthalic acid. It is also possible to use mixtures of carboxylic acids, like a mixture of adipic acid and glutaric acid, or maleic acid and adipic acid. Preferably adipic acid is used to produce the polyamidoamines. Suitable polyalkylene polyamines which may be condensed with the dicarboxylic acids are similar to the ones mentioned above, and can be exemplified by diethylenetriamine, triethylenetetraamine, dipropylenetriamine, tripropylenetetraamine, dihexamethylenetriamine, aminopropyl ethylenediamine as well as bis-aminopropyl ethylenediamine. Mixtures of polyalkylene polyamines may also be used to prepare polyamidoamines. Preferably the preparation of the polyamidoamines takes place in substance, however optionally the preparation can be carried out in inert solvents. The condensation reaction of the dicarboxylic acids with the polyalkylene polyamines is carried out at elevated temperatures such as in the range of from about 120° C. to about 220° C. The water formed during the reaction is distilled off the reaction mixture. Lactones or lactams derivable from carboxylic acids having 4 to 8 carbon atoms also may be present during the condensation reaction. Generally, 0.8 to 1.4 mole of polyalkyleneamines are used with each mole of dicarboxylic acid. The thus obtained polyamidoamines have primary and secondary NH-groups and are soluble in water.

A further compound which is suitable as component A includes ethyleneimine grafted polyamidoamines. Such products are obtainable by reacting ethyleneimine with the above described polyamidoamines in the presence of Bronnstedt-acids or Lewis-acids, such as sulfuric acid, phosphoric acid or boron trifluoride etherate. Such reaction conditions result in a graft of ethyleneimine to the polyamidoamine. For example, each alkaline nitrogen group of the polyamidoamine may be grafted with 1 to 10 ethyleneimine units, i.e. 10 to 500 parts by weight of ethyleneimine are used with 100 parts by weight of a polyamidoamine.

Still further compounds useful as component A include polyetheramines. Such compounds are known to the art and are described, for example, in DE-A 2916356. Polyetheramines are obtainable from condesing diamines and polyamines with chlorohydrin ethers at elevated temperatures. The polyamines may comprise up to 10 nitrogen atoms. The chlorohydrin ethers themselves can be prepared by reacting a dihydric alcohol having 2 to 5 carbon atoms, the alkoxylation products thereof having up to 60 alkyleneoxide units, glycerol or polyglycerol comprising up to 15 glycerol units, erythritol or pentaerythritol with epichlorohydrin. At least 2 to 8 moles of epichlorohydrin are reacted with each mole of said alcohol. The reaction of the diamines and the polyamines on one hand and the chlorohydrin ethers on the other hand generally takes place at temperatures of from about 1° C. to about 200° C., preferably of from 110° C. to 200° C. Moreover, polyetherpolyamines may be prepared by condesing diethanolamine or triethanolamine according to the methods known in the art, such as the methods disclosed in U.S. Pat. No. 4,404,362, U.S. Pat. No. 4,459,220 and U.S. Pat. No. 2,407,895.

Particularly preferred as component A are polyalkylene polyamines, which may be optionally are amidated up to 20%. Further preferred compounds include polyalkylene polyamines, especially polyethyleneimines, which have an average molecular weight of from about 800 to 2,000,000, more preferably from 200,000 to 1,000,000, and most preferably from 20,000 to 750,000.

Compounds suitable as component B include bifunctional cross-linking agents comprising halohydrin units, glycidyl units, aziridine units or isocyanate units or a halogen atom as functional groups.

By way of non-limiting example, suitable cross-linking agents include epihalohydrin, preferably epichlorohydrin, as well as α,ω-bis-(chlorohydrin)-polyalkylene glycol ether and the α,ω-bis-(epoxides) of polyalkylene glycol ethers which are obtainable therefrom by treatment with bases. The chlorohydrinethers may be prepared, for example, by reacting polyalkylene glycols with epichlorohydrin in a molar ratio of 1 to at least 2 to 5. Appropriate polyalkylene glycols include, for example, polyethylene glycol, polypropylene glycol and polybutylene glycol as well as block copolymers of $C_2$ to $C_4$ alkyleneoxides. The average molecular weight (Mw) of the polyalkylene glycols generally ranges from about 100 about to 6000, preferably from 300 to 2000 g/mol. α,ω-bis-(chlorohydrin) polyalkylene glycol ether are, per se, known to the art and for example are described in U.S. Pat. No. 4,144,123. Further, α,ω-dichloropolyalkylene glycols are also suitable as cross-linking agents, such as those disclosed in EP-A 0 025 515. Such α,ω-dichloropolyalkylene glycols are obtainable by reacting dihydric to tetrahydric alcohols, preferably alkoxylated dihydric to tetrahydric alcohols either with thionyl chloride resulting in a cleavage of HCI followed by catalytic decomposition of the chlorosulfonated compound while eliminating sulfur dioxide, or with phosgene resulting in the corresponding bis-chlorocarbonic acid ester while eliminating HCI, which bischlorocarbonic acid esters are catalytically decomposed eliminating carbondioxid to result in α,ω-dichloro ether. Preferably the dihydric to tetrahydric alcohols are ethoxylated and/or propoxylated glycols wherein each mole of glycol is reacted with 1 to 100, in particular with 4 to 40 moles of ethylene oxide.

Further appropriate crosslinking agent include α,ω- or vicinal dichloroalkanes, including but not limited to 1,2-dichloroethane, 1,2-dichloropropane, 1,3-dichloropropane, 1,4-dichlorobutane and 1,6-dichlorohexane. It is further to be understood that crosslinking agents which are obtainable from reacting at least trihydric alcohols with epichlorohydrin, resulting in reaction products having at least two chlorohydrin moieties may also be used. Examples for polyhydric alcohols are glycerol, ethoxylated or propoxylated glycerol, polyglycerol having 2 to 15 glycerol units within the molecule and optionally ethoxylated and/or propoxylated polyglycerol. Cross-linking agents of this kind are per se, known to the art and include those described in DE-A 2916356. Still further exemplary useful crosslinking agents include crosslinking agents containing blocked isocyanate groups such as trimethylhexamethylene diisocyanate blocked with 2,2,3,6-tetramethylpiperidone-4. Such cross-linking agents are also per se, know to the art and are described in DE-A 4028285. Moreover, crosslinking agents based on polyethers or substituted hydrocarbons containing aziridine moieties like 1,6-bis-N-aziridinohexane represent further suitable as cross-linking agents.

According to the present invention the cross-linking agents may be employed individually or as a mixture of two or more cross-linking agents. Particularly preferred are epihalohydrins, especially epichlorohydrin, α,ω-bis-(chlorohydrin) polyalkylene glycol ether, α,ω-bis-(epoxides) of polyalkylene glycol ethers and/or bisglycidylethers of polyalkylene glycols as component B.

Exemplary compounds suitable as component C include monoethylenically unsaturated carboxylic acids having preferably 3 to 18 carbon atoms in their alkenyl residue. Appropriate monoethylenically unsaturated carboxylic acids include by acrylic acid, methacrylic acid, diemethacrylic acid, ethyl acrylic acid, allyl acetic acid, vinyl acetic acid, maleic acid, fumaric acid, itaconic acid, methylene malonic acid, oleic acid and linoleic acid. Monoethylenically unsaturated carboxylic acids selected from the group comprising acrylic acid, methacrylic acid and maleic acid are especially preferred. It is also possible to use the salts of the aforementioned monoethylenically unsaturated carboxylic acids as component C. Suitable salts generally represent alkali metal, alkaline earth metal and ammonium salts of the aforementioned acids. Particularly preferred are sodium, potassium and ammonium salts Ammonium salts can be derived from ammonia as well as from amines or amine derivatives like ethanolamine, diethanolamine and triethanolamine. Examples for alkaline earth metal salts generally represent magnesium and calcium salts of the aforementioned monoethylenically unsaturated carboxylic acids.

Exemplary suitable esters of the aforementioned monoethylenically unsaturated carboxylic acids are derivable from monohydric $C_1$-$C_{20}$ alcohols or from dihydric $C_2$-$C_6$ alcohols. Esters which may be used herein can be exemplified by methyl acrylate, ethyl acrylate, n-propyl acrylate, isopropyl acrylate, n-butyl acrylate, isobutyl acrylate, methyl methacrylate, ethyl methacrylate, isopropyl methacrylate, n-butyl methacrylate, 2-ethylhexyl acrylate, 2-ethylhexyl methacrylate, palmityl acrylate, lauryl acrylate, diaryl acrylate, lauryl methacrylate, palmityl methacrylate, stearyl methacrylate, dimethyl maleate, diethyl maleate, isopropyl maleate, 2-hydroxyethyl acrylate, 2-hydroxyethyl methacrylate, 2-hydroxypropyl acrylate, 3-hydroxypropyl acrylate, 2-hydroxypropyl methacrylate, 3-hydroxypropyl methacrylate, hydroxybutyl acrylate, hydroxybutyl methacrylate and hydroxyhexyl acrylate and hydroxy-hexyl methacrylate.

Representative appropriate amides of monoethylenically unsaturated carboxylic acids include acrylamide, methacrylamide and oleic amide. Suitable nitriles of the mono-ethylenically unsaturated carboxylic acids are acrylonitrile and methacrylonitrile. Further contemplated as useful amides include amides which are derivable by reacting monoethylenically unsaturated carboxylic acids, in particular (meth) acrylic acid, with amidoalkane sulfonic acids. Those amides are especially advantageous which are obtainable from reacting monoethylenically unsaturated carboxylic acids, especially (meth)acrylic acid, with amidoalkane sulfonic acids, as represented by the following formulae I or II:

$$H_2C{=}CH{-}X{-}SO_3H \quad (I)$$

$$H_2C{=}C(CH_3){-}X{-}SO_3H \quad (II)$$

wherein X either is not present or when present is a spacing group according to one or more of the formulae: —C(O)—NH—$CH_{2-n}(CH_3)_n(CH_2)_m$—, —C(O)NH—, —C(O)—NH—$(CH(CH_3)CH_2)$— or —C(O)—NH—CH$(CH_2CH_3)$—, with n being 0 to 2 and m being 0 to 3. Particularly preferred are 1-acrylamido-1-propanesulfonic acid (X—C(O)—NH—$CH(CH_2CH_3)$— in formula I), 2-acrylamido-1-propanesulfonic acid (X═(O)—NH—(CH$(CH_3)CH_2)$— in formula I), 2-acrylamido-2-methyl-1-propanesulfonic acid (—C(O)—NH—$C(CH_3)_2(CH_2)$— in formula I), 2-methacrylamido-2-methyl-1-propanesulfonic acid (X═—C(O)—NH—$C(CH_3)_2(CH_2)$— in formula II) and vinylsulfonic acid (X not present in formula I).

Chlorocarboxylic acids are also appropriate as component C. Such chloro carboxylic acids include chloroacetic acid, 2-chloropropionic acid, 2-chlorobutanoic acid, dichloroacetic acid and 2,2'-dichloro propionic acid. Further compounds suitable as component C are glycidylcompounds which are represented by the following formula (III):

(III)

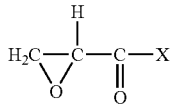

wherein:

X represents $NH_2$, OMe, OR

Me represents H, Na, K, ammonium, and

R represents $C_1$-$C_4$ alkyl or $C_2$-$C_4$ hydroxyalkyl.

Preferred compounds of formula III include but are not limited to: glycidyl acid, sodium, potassium, ammonium, magnesium or calcium salts thereof, glycidyl amide and glycidyl ester like glycidyl methyl ester, glycidyl ethyl ester, glycidyl n-propyl ester, glycidyl n-butyl ester, glycidyl iso-butyl ester, glycidyl-2-ethylhexyl ester, glycidyl-2-hydroxypropyl ester and glycidyl-4-hydroxybutyl ester. Glycidyl acid and sodium, potassium or ammonium salts thereof, or glycidyl amide are particularly preferred.

Preferably, a monoethylenically unsaturated carboxylic acid is used as component C, particularly wherein the monoethylenically unsaturated carboxylic acid is one or more of acrylic acid, methacrylic acid or maleic acid, and especially preferably wherein the monoethylenically unsaturated carboxylic acid is acrylic acid.

The above described preferred amphoteric organic polynitrogen compounds can be produced according to methods known in the art. Exemplary methods of production are disclosed for example in DE-A 424-4194, in which component A at first reacts with component C and afterwards component B is added. According to the disclosure of DE-A 4244194 it is also possible to have components C and B reacted simultaneously with component A. In a preferred embodiment the amphoteric organic polynitrogen compounds comprising components A, B and C are prepared using a process comprising the following steps:

AA) cross-linking of polyalkylene polyamines, polyamidoamines, ethyleneimine-grafted polyaminoamides, polyetheramines or mixtures thereof as component A with at least bifunctional cross-linking agents having a functional group independently selected from a halohydrin, a glycidyl, an aziridine or an isocyanate moiety or a halogen atom, as component B, and BB) reacting the product obtained in step i) with monoethylenically unsaturated carboxylic acids; salts, esters, amides or nitriles of monoethylenically unsaturated carboxylic acids, chlorocarboxylic acids and/or glycidyl compounds like glycidyl acid, glycidyl amide or glycidyl esters as component C.

In step AA), the cross-linking of the compounds exemplified for component A with the cross-linking agents C proceeds according to methods known to the skilled person. Generally, the cross-linking is carried out at a temperature of from about 10° C. to about 200° C., preferably of from 30° C. to 100° C. and typically at standard pressure. The reaction times depend on the components A and B used, and in most cases range from 0.5 to 20 hours, preferably from 1 to 10 hours. In general, curing component B is added in the form of an aqueous solution such that the reaction take place in aqueous medium as well. The product obtained can be isolated or directly used in step BBj) without further isolation which is preferred.

In step BB), the reaction product obtained in step AA) is reacted with the compound according to group C. If the compound of group C comprises a monoethylenically unsaturated compound having a double bonding system the primary or secondary amine groups of the cross-linked product obtained in step AA) are added to the free end of the double bond similar to a Michael-addition. If the compound of group C is a chlorocarboxylic acid or a glycidyl compound of formula I the reaction of the amine moieties proceeds at the chloro group or the epoxy group. The reaction typically is carried out at a temperature of from about 10° C. to about 200° C., preferably of from 30° C. to 100° C. and usually at standard pressure. The reaction time depends on the components used and generally lies within the range of from 0.5 to 100 hours, preferably from 1 to 50 hours. It is contemplated that the foregoing reaction may take place in an aqueous solution wherein the reaction product obtained in step AA) already is present in an aqueous solution.

Specific, albeit nonlimiting examples for the preparation of such compounds are also described in WO 2005/073357 A2.

One particularly preferred compound of the amphoteric organic polynitrogen compounds as specified above, which may be used as the film forming constituent in the compositions of the present invention is presently commercially available under the trade name SOKALAN HP70 (ex. BASF AG).

Further exemplary film forming constituent useful in the compositions of the present invention include maleic acid/olefin copolymers useful as the film forming constituent of the present invention include maleic acid/olefin copolymers which may be represented by the following formula (IV):

(IV)

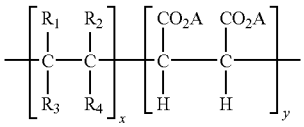

Especially preferred are maleic acid/olefin copolymers of formula IV wherein A is selected frown the group of hydrogen, ammonium or an alkali metal; and $R_1$, $R_2$, $R_3$ and $R_4$ are each independently selected from the group of hydrogen or an alkyl group, which alkyl group may be straight or branched, saturated or unsaturated, containing from 1 to about 8 carbon atoms, preferably from 1 to about 5 carbon atoms. The monomer ratio of x to y is from about 1:5 to about 5:1, preferably from about 1:3 to about 3:1, and most preferably from 1.5:1 to about 1:1.5. The average molecular weight of the maleic acid/olefin copolymer will typically be less than about 20,000, more typically between about 4,000 and about 12,000.

A preferred maleic acid-olefin copolymer is a maleic acid-di-isobutylene copolymer having an average molecular weight of about 12,000 and a monomer ratio (x to y) of about 1:1. Such a copolymer is presently commercially available as SOKALAN CP-9, and is believed to be represented by formula IV wherein A is hydrogen or sodium, $R_1$ and $R_3$ are hydrogen, $R_2$ is methyl, and $R_4$ is neopentyl. Another preferred product is a maleic acid-trimethyl isobutylene ethylene copolymer according to formula IV wherein A is hydrogen or sodium, $R_1$ and $R_3$ are each methyl, $R_2$ is hydrogen and $R_4$ is tertiary butyl.

It is of course contemplated that a mixture or blend of two or more distinct compounds or materials may be used to provide the film forming constituent of the inventive compositions.

In addition to the film forming materials described immediately above, other film forming materials which are compatible with the balance of the constituents present in an inventive composition are also contemplated as being useful and within the scope of the present invention.

According to certain and preferred aspects of the invention there is necessarily included a bleach constituent. The bleach constituent is relatively inert in the dry state but, which on contact with water, releases oxygen, hypohalite or a halogen especially chlorine. Representative examples of typical oxygen-release bleaching agents, suitable for incorporation in the solid block composition include the alkali metal perborates, e.g., sodium perborate, and alkali metal monopersulfates, e.g., sodium monopersulfates, potassium monopersulfate, alkali metal monoperphosphates, e.g., disodium monoperphosphate and dipotassium monoperphosphate, as well as other conventional bleaching agents capable of liberating hypohalite, e.g., hypochlorite and/or hypobromite, include heterocyclic N-bromo- and N-chloro-cyanurates such as trichloroisocyanuric and tribromoiscyanuric acid, dibromocyanuric acid, dichlorocyanuric acid, N-monobromo-N-mono-chlorocyanuric acid and N-monobromo-N,N-dichlorocyanuric acid, as well as the salts thereof with water solubilizing cations such as potassium and sodium, e.g., sodium N-monobromo-N-monochlorocyanurate, potassium dichlorocyanurate, sodium dichlorocyanurate, as well as other N-bromo and N-chloro-imides, such as N-brominated and N-chlorinated succinimide, malonimide, phthalimide and naphthalimide. Also useful in the solid block composition as hypohalite-releasing bleaches are halohydantoins which may be used include those which may be represented by the general structure:

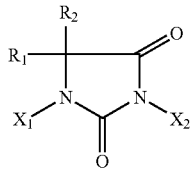

wherein:

$X_1$ and $X_2$ are independently hydrogen, chlorine or bromine; and, $R_1$ and $R_2$ are independently alkyl groups having from 1 to 6 carbon atoms. Examples of halohydantoins include, for example, N,N'-dichloro-dimethyl-hydantoin, N-bromo-N-chloro-dimethyl-hydantoin, N,N'-dibromo-dimethyl-hydantoin, 1,4-dichloro, 5,5-dialkyl substituted hydantoin, wherein each alkyl group independently has 1 to 6 carbon atoms, N-monohalogenated hydantoins such as chlorodimethylhydantoin (MCDMH) and N-bromo-dimethylhydantoin (MBDMH); dihalogenated hydantoins such as dichlorodimethylhydantoin (DCDMH), dibromodimethylhydantoin (DBDMH), and 1-bromo-3-chloro-5,5-dimethylhydantoin (BCDMH); and halogenated methylethylhydantoins such as chloromethylethylhydantion (MCMEH), dichloromethylethylhydantoin (DCMEH), bromomethylethylhydantoin (MBMEH), dibromomethylethylhydantoin (DBMEH), and bromochloromethylethylhydantoin (BCMEH), and mixtures thereof. Other suitable organic hypohalite liberating bleaching agents include halogenated melamines such as tribromomelamine and trichloromelamine. Suitable inorganic hypohalite-releasing bleaching agents include lithium and calcium hypochlorites and hypobromites. The various chlorine, bromine or hypohalite liberating agents may, if desired, be provided in the form of stable, solid complexes or hydrates, such as sodium p-toluene sulfobromamine trihydrate; sodium benzene sulfochloramine dihydrate; calcium hypobromite tetrahydrate; and calcium hypochlorite tetrahydrate. Brominated and chlorinated trisodium phosphates formed by the reaction of the corresponding sodium hypohalite solution with trisodium orthophosphate (and water, as necessary) likewise comprise useful inorganic bleaching agents for incorporation into the inventive solid block composition and the treatment blocks formed therefrom.

Preferably, the bleach constituent necessarily present according to the second aspect of the solid block composition of the invention is a hypohalite liberating compound and more preferably is a hypohalite liberating compound in the form of a solid complex or hydrate thereof. Particularly preferred for use as the bleach constituent are chloroisocynanuric acids and alkali metal salts thereof, preferably potassium, and especially sodium salts thereof. Examples of such compounds include trichloroisocyananuric acid, dichloroisocyanuric acid, sodium dichloroisocyanurate, potassium dichloroisocyanurate, and trichloro-potassium dichloroisocynanurate complex. The most preferred chlorine bleach material is sodium dichloroisocyanurate; the dihydrate of this material is particularly preferred.

The bleach constituent may be present in any effective amount and may comprise up to about 90% wt. of the solid block composition and the resultant treatment block formed therefrom. Preferably however the bleach constituent comprises at least about 0.1-60% wt. of the total weight of the solid block composition, and the resultant treatment block formed therefrom, irregardless of use as an ITC or ITB type treatment block. More preferably the bleach constituent comprises about 0.5-50% wt., more preferably at least 1-40% wt. of the solid block composition.

While the solid block composition of the present invention can be made up entirely of the surfactant constituent, the film forming constituent, and optionally the bleach constituent, in most instances it is nonetheless highly desirable to include additional constituents in the solid block composition. Other constituents may be incorporated into the blocks of the invention as long as they do not adversely affect the properties of the treatment block formed from the solid block composition. It will be noted that for several of the optional constituents as described below, interaction of the components with hypochlorite bleaches, or stability of the components with respect to hypochlorite bleaches are to be considered with respect to the selection of suitable constituents which may be included in the solid block composition.

The solid treatment blocks may include a hydrocarbon solvent constituent. Such hydrocarbon solvents are immiscible in water, may be linear or branched, saturated or unsaturated hydrocarbons having from about 6 to about 24 carbon atoms, preferably comprising from about 12 to about 16 carbon atoms. Saturated hydrocarbons are preferred, as are branched hydrocarbons. Such hydrocarbon solvents are typically available as technical grade mixtures of two or more specific solvent compounds, and are often petroleum distillates. Nonlimiting examples of some suitable linear hydrocarbons include decane, dodecane, decene, tridecene, and combinations thereof. Mineral oil is one particularly preferred form of a useful hydrocarbon solvent. Further preferred hydrocarbon solvents include paraffinic hydrocarbons including both linear and branched paraffinic hydrocarbons. The former are commercially available as NORPAR solvents (ex. ExxonMobil Corp.) while the latter are available as ISOPAR solvents (ex. ExxonMobil Corp.) Mixtures of branched hydrocarbons especially as isoparaffins form a further particularly preferred form of a useful hydrocarbon solvent of the invention. Particularly useful technical grade mixtures of isoparaffins include mixtures of isoparaffinic organic solvents having a relatively narrow boiling range. Examples of these commercially available isoparaffinic organic solvents include ISOPAR C described to be primarily a mixture of $C_7$-$C_8$ isoparaffins, ISOPAR E described to be primarily a mixture of $C_8$-$C_9$ isoparaffins, ISOPAR G described to be primarily a mixture of $C_{10}$-$C_{11}$ isoparaffins, ISOPAR H described to be primarily a mixture of $C_{11}$-$C_{12}$ isoparaffins, ISOPAR J, ISOPAR K described to be primarily a mixture of $C_{11}$-$C_{12}$ isoparaffins, ISOPAR L described to be primarily a mixture of $C_{11}$-$C_{13}$ isoparaffins, ISOPAR M described to be primarily a mixture of $C_{13}$-$C_{14}$ isoparaffins, ISOPAR P and ISOPAR V described to be primarily a mixture of $C_{12}$-$C_{20}$ isoparaffins.

Preferred hydrocarbon solvents are those which exhibit a flashpoint of at least about 75° C., preferably at least about 80° C. The flashpoints of the hydrocarbon solvents may be determined according to routine analytical methods, but are frequently recited in the product literature or product specifications available from the supplier of the hydrocarbon solvent.

The hydrocarbon solvent constituent may be present in any effective amount and generally comprises at least about 0.1% wt. of the total weight of the solid block composition, and the resultant treatment block formed therefrom. Preferably the hydrocarbon solvent constituent comprises about 1-10% wt., more preferably from about 2.5-8% wt. of the solid block composition.

According to preferred embodiments of the invention, further organic solvents other than those recited above with reference to the hydrocarbon solvent constituent are absent from the solid block compositions and the treatment blocks taught herein.

The inclusion of the hydrocarbon solvent constituent in the solid block composition provides several advantageous technical benefits. The inclusion of effective amounts of the hydrocarbon solvent functions as an excellent processing aid during mixing, which decreases the temperature of the solid block composition in mixing and extrusion apparatus used to form the solid mass formed therefrom, namely the treatment blocks of the invention. The ability to process at lower temperature also provides for the decreased likelihood of the degradation of one or more of the constituents in the solid block compositions during processing, particularly non-halogen releasing constituents which may be deleteriously affected when contacted with the bleach constituent. Further the inclusion of the hydrocarbon solvent constituent functions as an excellent binding agent which aids in the retention of physical integrity of the treatment block during use either as in an ITB mode or in an ITC mode. Block integrity is advantageously retained in spite of the presence of reactive bleach constituents, which may be present in treatment blocks according to certain aspects of the invention.

The solid block compositions as well as the treatment blocks formed therefrom may comprise a diester constituent which functions as a useful processing aid in formation of the treatment blocks of the invention. The diester constituent is one or more compounds which may be represented by the following structure:

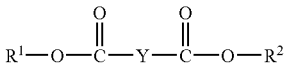

wherein:

$R^1$ and $R^2$ can independently be $C_1$-$C_6$ alkyl which may optionally substituted, Y is $(CH_2)_x$, wherein x is 0-10, but is preferably 1-8, and while Y may be a linear alkyl or phenyl moiety, desirably Y includes one or more oxygen atoms and/or is a branched moiety.

Exemplary diester constituents include the following diester compounds according to the foregoing structure: dimethyl oxalate, diethyl oxalate, diethyl oxalate, dipropyl oxalate, dibutyl oxalate, diisobutyl oxalate, dimethyl succinate, diethyl succinate, diethylhexyl succinate, dimethyl glutarate, diisostearyl glutarate, dimethyl adipate, diethyl adipate, diisopropyl adipate, dipropyl adipate, dibutyl adipate, diisobutyl adipate, dihexyladipate, adipate, dicapryl adipate, dicetyl adipate, diisodecyl adipate, diisocetyl adipate, diisononyl adipate, diheptylundecyl adipate, ditridecyl adipate, diisostearyl adipate, diethyl sebacate, diisopropyl sebacate, dibutyl sebacate, diethylhexylsebacate, diisocetyl dodecanedioate, dimethyl brassylate, dimethyl phthalate, diethyl phthalate, dibutyl phthalate.

Further exemplary useful diester compounds include those wherein:

Y represents a —CH═CH— moiety such as in dibehenyl fumarate, di-$C_{12-15}$ alkyl fumarate, di-$C_{12-15}$ alkyl maleate, dicapryl maleate, diethylhexylmaleate, diisostearyl fumarate;

Y represents a —CH(OH)—$CH_2$— moiety such as in di-$C_{12-13}$ alkyl malate and diisostearyl malate;

Y represents a —CH(OH)—CH(OH)— moiety such as in di-$C_{12-13}$ alkyl tartrate, di-$C_{14-15}$ alkyl tartrate and dimyristyl tartrate;

Y represents a —$CH_2$—CH($SO_3Na$)— moiety such as in diamyl sodium sulfosuccinate, dicapryl sodium sulfosuccinate, dicyclohexyl sodium sulfosuccinate, diethylhexyl sodium sulfosuccinate, dihexyl sodium sulfosuccinate, diheptyl sodium sulfosuccinate, diisobutyl sodium sulfosuccinate, and ditridecyl sodium sulfosuccinate;

Y represents a —$CH_2$—CH($HNCOCH_3$)— moiety such as in diethyl acetyl aspartate;

Y represents a —$CH_2$—CH($NH_2$)— moiety such as in diethyl aspartate;

Y represents a —$CH_2CH_2CH(NH_2)$— moiety such as in diethyl glutamate;

Y represents a —$CH_2$—CH($HNCO(CH_2)_{14}$—$CH_3$)— moiety such as in diethyl palmitoyl aspartate;

Y represents a —C(O)—$CH_2$—C(O)—$CH_2$—C(O)— moiety such as in diethyl trioxopimelate;

Y represents a —$CH_2$—C(OH)(COOH)—$CH_2$— moiety such as in dilauryl citrate.

Further exemplary useful diester compounds wherein the Y moiety is branched include wherein:

Y represents a —$CH_2$—C(OH)(COOR)—$CH_2$— moiety such as in tributyl citrate, triethyl citrate, triisopropyl citrate, triethylhexyl citrate, tri-$C_{12-13}$ alkyl citrate, tri-$C_{14-15}$ alkyl citrate, tricaprylyl citrate, triisocetyl citrate, trioleyl citrate, tristearyl citrate, triisostearyl citrate, trilauryl citrate, and trioctyldodecyl citrate.

Preferred diester constituents include those wherein Y is —$(CH_2)_x$— wherein x has a value of from 0-6, preferably a value of 0-5, more preferably a value of from 1-4, while $R^1$ and $R^2$ are $C_1$-$C_6$ alkyl groups which may be straight chained alkyl but preferably are branched, e.g., iso- and tert-moieties. Particularly preferred diester compounds are those in which the compounds terminate in ester groups.

Further preferred diester constituents also include those wherein Y represents a moiety selected from: —$CH_2$—CH($SO_3Na$)—, —$CH_2$—CH($HNCOCH_3$)—, —$CH_2$—CH($NH_2$)—, —$CH_2CH_2CH(NH_2)$—, and —C(O)—$CH_2$—C(O)—$CH_2$—C(O)—. Particularly preferred diester compounds are those in which the compounds terminate in ester groups.

The diester constituent may be present in any effective amount and but generally does not exceed about 40% wt. of the total weight of the solid block composition, and the resultant treatment block formed therefrom. Wherein the solid treatment block is intended to be used in an ITB application the preferably the diester constituent comprises about 0.01-20% wt., more preferably from about 2-10% wt. and most preferably from about 2-6% wt. of the solid block composition, and the resultant treatment block formed therefrom. Wherein the solid treatment block is intended to be used in an ITC application the diester constituent comprises to about 40% wt, preferably about 0.01-20% wt., more preferably from about 4-20% wt. and most preferably from about 4-16% wt. of the solid block composition, and the resultant treatment block formed therefrom.

The present inventor has found that the inclusion of the diester constituent in the solid block composition provides for improved compositions which may be processed into solid forms, e.g., treatment blocks at lower process temperatures than frequently required of conventional processing aids. The ability to process at lower temperature also provides for the decreased likelihood of the degradation of one or more of the constituents in the solid block compositions during processing, particularly non-halogen releasing constituents which may be deleteriously affected when contacted with the bleach constituent. Further, it is believed that the treatment blocks formed from the inventive compositions exhibit improved physical stability during the usage of the treatment block either as in an ITC or ITB type application.

The inventive solid block compositions may include one or more colorants used to impart a color to the solid block composition, or to the water with which the solid block composition contacts or both. Exemplary useful colorants include any materials which may provide a desired coloring effect. Exemplary useful coloring agents include dyes, e.g., Alizarine Light Blue B (C.I. 63010), Carta Blue VP (C.I. 24401), Acid Green 2G (C.I. 42085), Astragon Green D (C.I. 42040) Supranol Cyanine 7B (C.I. 42675), Maxilon Blue 3RL (C.I. Basic Blue 80), acid yellow 23, acid violet 17, a direct violet dye (Direct violet 51), Drimarine Blue Z-RL (C.I. Reactive Blue 18), Alizarine Light Blue H-RL (C.I. Acid Blue 182), FD&C Blue No. 1, FD&C Green No. 3 and Acid Blue No. 9. When a bleach constituent is included in the solid block composition, the colorant, e.g., dye, should be selected so to ensure the compatibility of the colorant with the bleach constituent, or so that its color persists despite the presence in the toilet bowl of a concentration of hypochlorite which is effective to maintain sanitary conditions. Frequently however, a solid block composition which includes a bleach constituent do not comprise any colorants. Desirably the colorants, when present, do not exceed 15% wt. of the solid block composition, although generally lesser amounts are usually effective.

The solid block composition of the invention may include one or more perfumes which impart desirable scent characteristics to the solid blocks formed from the solid block composition taught herein. Exemplary perfumes may be any material giving an acceptable odor and thus materials giving a "disinfectant" odor such as essential oils, pine extracts, terpinolenes, ortho phenyl phenol or paradichlorobenzene may be employed. The essential oils and pine extracts also contribute as plasticizers and are functional to a degree in extending block life. The perfume may be in solid form and is suitably present in an amount up to 10% by weight of the solid block composition.

Exemplary, albeit optional constituents are stain inhibiting materials. The solid block composition of the invention may, for example, include an effective amount of a manganese stain inhibiting agent which is advantageously included wherein the sanitary appliance is supplied by a water source having an appreciable or high amount of manganese. Such water containing a high manganese content are known to frequently deposit unsightly stains on surfaces of sanitary appliances, especially when the solid block composition also contains a bleach source which provides a hypochlorite. To counteract such an effect the solid block composition of the present invention may comprise a manganese stain inhibiting agent, such as a partially hydrolyzed polyacrylamide having a molecular weight of about 2000 to about 10,000, a polyacrylate with a molecular weight of about 2000 to about 10,000, and/or copolymers of ethylene and maleic acid anhydride with a molecular weight of from about 20,000 to about 100,000. When present the satin inhibiting materials may comprise to about 10% wt. of the solid block composition.

The solid block composition of the invention may include a germicide. Exemplary suitable germicides include, for example, formaldehyde release agents, chlorinated phenols, as well as iodophors. It is to be understood that certain cationic surfactants including quaternary ammonium compound based surfactants may also provide a germicidal benefit and may be used in place of the optional further germicide constituent recited here. Further exemplary useful germicides which may be included include methylchloroisothiazolinone/methylisothiazolinone sodium sulfite, sodium bisulfite, imidazolidinyl urea, diazolidinyl urea, benzyl alcohol, 2-bromo-2-nitropropane-1,3-diol, formalin (formaldehyde), iodopropenyl butylcarbamate, chloroacetamide, methanamine, methyldibromonitrile glutaronitrile, glutaraldehyde, 5-bromo-5-nitro-1,3-dioxane, phenethyl alcohol, o-phenylphenol/sodium o-phenylphenol, sodium hydroxymethylglycinate, polymethoxy bicyclic oxazolidine, dimethoxane, thimersal dichlorobenzyl alcohol, captan, chlorphenenesin, dichlorophene, chlorbutanol, glyceryl laurate, halogenated diphenyl ethers, phenolic compounds, mono- and poly-alkyl and aromatic halophenols, resorcinol and its derivatives, bisphenolic compounds, benzoic esters (parabens), halogenated carbanilides, 3-trifluoromethyl-4,4'-dichlorocarbanilide, and 3,3',4-trichlorocarbanilide. More preferably, the non-cationic antimicrobial agent is a mono- and poly-alkyl and aromatic halophenol selected from the group p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, and 5-chloro-2-hydroxydiphenylmethane.

When present the germicide is included in the solid block composition in germicidally effective amounts, generally in amounts of up to about 25% wt. of the solid block composition, although generally lesser amounts are usually effective.

A further optional constituent are one or more preservatives. Such preservatives are primarily included to reduce the growth of undesired microorganisms within the treatment blocks formed from the solid block composition during storage prior to use or while used, although it is expected that the such a preservative may impart a beneficial antimicrobial effect to the water in the sanitary appliance to which the treatment block is provided. Exemplary useful preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. For reasons of availability, the most preferred preservative are those commercially available preservative comprising a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEXTAMER® 38AD which is presently commercially available from Calgon Corp. (Pittsburgh, Pa.). When present, the optional preservative constituent should not exceed about 5% wt. of the solid block composition, although generally lesser amounts are usually effective.

The inventive solid block composition may include a binder constituent. The binder may function in part controlling the rate of dissolution of the tablet. The binder constituent may be a clay, but preferably is a water-soluble or water-dispersible gel-forming organic polymer. The term "gel-forming" as applied to this polymer is intended to indicate that on dissolution or dispersion in water it first forms a gel which, upon dilution with further water, is dissolved or dispersed to form a free-flowing liquid. The organic polymer serves essentially as binder for the tablets produced in accordance with the invention although, as will be appreciated, certain of the polymers envisaged for use in accordance with the invention also have surface active properties and thereby serve not only as binders but also enhance the cleansing ability of the tablets of the invention. Further certain organic polymers, such as substituted celluloses, also serve as soil antiredeposition agents. A wide variety of water-soluble organic polymers are suitable for use in the solid block composition of the present invention. Such polymers may be wholly synthetic or may be semi-synthetic organic polymers derived from natural materials. Thus, for example, on class of organic polymers for use in accordance with the invention are chemically modified celluloses such as ethyl cellulose, methyl cellulose, sodium carboxymethyl cellulose, hydroxypropyl cellulose, hydroxypropyl methyl cellulose, ethyl hydroxyethyl cellulose, carboxymethyl hydroxyethyl cellulose, and hydroxyethyl cellulose. Another class of organic polymers which may be used include naturally derived or manufactured (fermented) polymeric materials such as alginates and carageenan. Also, water-soluble starches and gelatin may be used as the optional binder constituent. The cellulose based binders are a preferred class of binders for use in the solid block composition and may possess the property of inverse solubility that is their solubility decreases with increasing temperature, thereby rendering the tablets of the invention suitable for use in locations having a relatively high ambient temperature.

The optional binder constituent may also be one or more synthetic polymers e.g., polyvinyl alcohols; water-soluble partially hydrolyzed polyvinyl acetates; polyacrylonitriles; polyvinyl pyrrolidones; water-soluble polymers of ethylenically unsaturated carboxylic acids, such as acrylic acid and methacrylic acid, and salts thereof; base-hydrolysed starch-polyacrylonitrile copolymers; polyacrylamides; ethylene oxide polymers and copolymers; as well as carboxypolymethylenes.

In the case of the organic polymeric binders it may be noted that, in general, the higher the molecular weight of the polymer the greater the in-use life of the treatment block of the invention. When present, the total binder content may comprise up to 75% wt. of the solid block composition, but preferably is from 0.5 to 70% by weight, preferably from 1 to 65% by weight, more preferably from 5 to 60% by weight.

The solid block composition may optionally include one or more dissolution control agents. Such dissolution control agent are materials which provide a degree of hydrophobicity to the treatment block formed from the solid block composition whose presence in the treatment block contributes to the slow uniform dissolution of the treatment block when contacted with water, and simultaneously the controlled release of the active constituents of the solid block composition. Preferred for use as the dissolution control agents are mono- or di-alkanol amides derived from $C_8$-$C_{16}$ fatty acids, especially $C_{12}$-$C_{14}$ fatty acids having a $C_2$-$C_6$ monoamine or diamine moiety. When included the dissolution control agent may be included in any effective amount. Generally wherein the treatment block is to be used in an ITB application the dissolution control agent is present to about 12% wt., more preferably is present from 0.1-10% wt. and most preferably is present from about 3-8% wt. of the solid block compositions, as well as in the treatment blocks formed therefrom. Generally wherein the treatment block is to be used in an ITC application the dissolution control agent is present to about 50% wt., more preferably is present from 1-50% wt. and most preferably is present from about 10-40% wt. of the solid block compositions, as well as in the treatment blocks formed therefrom.

The solid block composition may optionally include one or more water-softening agents or one or more chelating agents, for example inorganic water-softening agents such as sodium hexametaphosphate or other alkali metal polyphosphates or organic water-softening agents such as ethylenediaminetetraacetic acid and nitrilotriacetic acid and alkali metal salts thereof. When present, such water-softening agents or chelating agents should not exceed about 20% wt. of the solid block composition, although generally lesser amounts are usually effective.

The solid block composition may optionally include one or more solid water-soluble acids or acid-release agents such as sulphamic acid, citric acid or sodium hydrogen sulphate. When present, such solid water-soluble acids or acid-release agents should not exceed about 20% wt. of the solid block composition, although generally lesser amounts are usually effective.

Diluent materials may be included to provide additional bulk of the product solid block composition and may enhance leaching out of the surfactant constituent when the solid block composition is placed in water. Exemplary diluent materials include any soluble inorganic alkali, alkaline earth metal salt or hydrate thereof, for example, chlorides such as sodium chloride, magnesium chloride and the like, carbonates and bicarbonates such as sodium carbonate, sodium bicarbonate and the like, sulfates such as magnesium sulfate, copper sulfate, sodium sulfate, zinc sulfate and the like, borax, borates such as sodium borate and the like, as well as others known to the art but not particularly recited herein. Exemplary organic diluents include, inter alia, urea, as well as water soluble high molecular weight polyethylene glycol and polypropylene glycol. When present, such diluent materials should not exceed about 40% wt. of the solid block composition, although generally lesser amounts are usually effective.

The solid block composition and treatment blocks formed therefrom may include one or more fillers. Such fillers are typically particulate solid water-insoluble materials which may be based on inorganic materials such as talc or silica, particulate organic polymeric materials such as finely comminuted water insoluble synthetic polymers. When present, such fillers should not exceed about 10% wt. of the solid block composition, although generally lesser amounts are usually effective.

The solid block composition and treatment blocks formed therefrom may include one or more further processing aids. For example, the solid block composition may also include other binding and/or plasticizing ingredients serving to assist in the manufacture thereof, for example, polypropylene glycol having a molecular weight from about 300 to about 10,000 in an amount up to about 20% by weight, preferably about 4% to about 15% by weight of the mixture may be used. The polypropylene glycol reduces the melt viscosity, acts as a demolding agent and also acts to plasticize the block when the composition is prepared by a casting process. Other suitable plasticizers such as pine oil fractions, d-limonene, dipentene and the ethylene oxide-propylene oxide block copolymers may be utilized. Other useful processing aids include tabletting lubricants such as metallic stearates, stearic acid, paraffin oils or waxes or sodium borate which facilitate in the formation of the treatment blocks in a tabletting press or die. When present such further processing aids are typically included in amounts of up to about 10% by weight of the solid block composition, although generally lesser amounts are usually effective.

The solid block composition may also include one or more biostatic components which reduce the degree of visual discoloration, e.g., yellowing of the water which remains in the bottom of a lavatory appliance, e.g., toilet bowl between flush cycles. Such discoloration is believed to be attributable to the growth of microorganisms in this body of water and may become particularly pronounced in warm climates, or periods of longer duration between flush cycles, or both which conditions foster the growth of such undesired microorganisms. Exemplary useful materials include inorganic and organic acids, e.g., citric acid, sulfamic acid, as well as alkali materials, e.g., alkali metal carbonates, bicarbonates, and the like. These may be included any effective amount; advantageously one or more biostatic components may be present in amounts of 5% wt, and less.

Ideally the treatment blocks formed from the solid block composition exhibit a density greater than that of water which ensures that they will sink when suspended in a body of water, e.g., the water present within a cistern. Preferably the treatment blocks formed from the solid block composition exhibit a density in excess of about 1 g/cc of water, preferably a density in excess of about 1.5 g/cc of water and most preferably a density of at least about 2 g/cc of water.

The treatment blocks according to the present invention may also be provided with a coating of a water-soluble film, such as polyvinyl acetate following the formation of the treatment blocks from the recited solid block composition. Such may be desired for improved handling, however such is often unnecessary as preferred embodiments of the treatment blocks exhibit a lower likelihood of sticking to one another following manufacture than many prior art treatment block compositions.

The treatment blocks formed from the solid block composition may be used with or without an ancillary device or structure, viz, a holder or cage. In one manner of use one or more treatment blocks are supplied to the cistern of a toilet where they sink and typically rest upon the bottom until they are consumed. In another manner of use one or more treatment blocks are supplied to the interior of a sanitary appliance, e.g., a toilet bowl or interior of a urinal wherein the treatment block(s) are within the path of flush water flushed through the sanitary appliance during its normal manner of use.

The manufacture of the solid treatment blocks from the solid block composition according to the present invention is well within the capability of persons of ordinary skill in the art. Exemplary useful processes contemplate by mixing the included constituents into a homogeneous mass and noodling, plodding, extruding, cutting and stamping the mass to form uniform bars or cakes. The constituents ultimately present in the solid blocks are preferably formed by tabletting, casting or extrusion using known techniques. Most preferably solid blocks are conveniently and preferably made by extrusion. Usually all of the solid ingredients are mixed in any suitable blending equipment followed by the addition of liquid ingredients under blending conditions. The resulting homogeneous blend is then extruded.

The blocks of the invention are conveniently formed by a compression process, especially an extrusion process comprising the steps of forming a mixture of the components of the composition, extruding this mixture into rod or bar form and then cutting the extruded rod or bar into appropriately sized pieces or blocks. Typically, the treatment blocks of the present invention weigh from 25 to 150 grams, preferably from about 25 to about 75 grams. The blocks are typically cylindrical in shape, having a length of from about ½ to about 2 inches and having a diameter of about 1 to about 3 inches.

The service life of the treatment blocks should be from about 30 to about 90 days when installed in a toilet tank, based on normal use. The length of life of the product blocks will depend on a variety of factors including product formulation, water temperature, tank size, and the number of flushes over the period of use.

The treatment blocks according to the invention are effective in remediating, reducing or controlling the buildup of limescale on treated surfaces of lavatory appliances, particularly toilet bowls, urinals, and bidets. Thus in one important aspect the present invention includes a method of reducing limescale deposition on hard surfaces of a lavatory appliance which method comprises the steps of:

providing a treatment block composition as described above and placing the treatment block composition in the path of flush water supplied to the lavatory appliance such that the flush water contacts the treatment block composition and dissolves at least a part of the treatment block composition in order to form a treatment composition, and providing the treatment compositions to the interior surfaces of the lavatory appliance.

In order to further illustrate the present invention, various examples including preferred embodiments of the invention are described amongst the examples. In these examples, as well as throughout the balance of this specification and claims, all parts and percentages are by weight unless otherwise indicated.

EXAMPLES

Treatment blocks according to the invention were produced from solid block compositions described on Table 1, following:

TABLE 1

| | Ex. 1 | Ex. 2 | Ex. 3 | Ex. 4 | Ex. 5 |
|---|---|---|---|---|---|
| $C_{10}$-$C_{14}$benzene sulfonate, sodium salt (80%) | 35 | 32.75 | 33.25 | 30.82 | 30.32 |
| lauryl monoethanol amide (98%) | 5 | 1.5 | — | 1.5 | 1.5 |
| alkene sulfonate, sodium salt, | 32 | 36 | 38 | 36.5 | 36.50 |
| $C_{12}$-$C_{16}$ ethoxy (2-3 EO) sulfate, sodium salt (70%) | 1 | 1 | — | 1.5 | 1.5 |
| silica | 2 | 2 | 2 | 2 | 2 |
| sodium sulfate | 21 | 21 | 21 | 21 | 21 |
| 3-(trimethoxysilyl)propyloctadecyldimethyl ammonium chloride (72%) | 0.25 | 0.25 | 0.25 | 0.31 | 0.31 |
| citric acid | — | — | 2.5 | 4.2 | 4.2 |
| sodium bicarbonate | — | — | 1 | — | — |
| DI water | 3.75 | 2 | 2 | 2.17 | 2.17 |

TABLE 1-continued

| | Ex. 6 | Ex. 7 | Ex. 8 | Ex. 9 | Ex. 10 | Ex. 11 |
|---|---|---|---|---|---|---|
| $C_{10}$-$C_{14}$benzene sulfonate, sodium salt (80%) | 35 | 35 | 35 | 35 | 35 | 35 |
| lauryl monoethanol amide (98%) | 5 | — | 3 | 3 | — | — |
| alkene sulfonate, sodium salt, | 32 | 38.3 | 32 | 32 | 38 | 34.75 |
| $C_{12}$-$C_{16}$ ethoxy (2-3 EO) sulfate, sodium salt (70%) | 2.5 | — | — | — | — | — |
| silica | 2 | 2 | 2 | 2 | 2 | 2 |
| sodium sulfate | 19.5 | 20.7 | 14 | 14 | 20.75 | 14 |
| sulfamic acid | — | — | 10 | — | — | 10 |
| citric acid | — | — | — | 10 | — | — |
| polyoxyethylene (16) tallow ethylammonioum ethosfulfate (100%) | 2.5 | 2.5 | 2.5 | 2.5 | 2.5 | 2.5 |
| DI water | 1.5 | 1.5 | 1.5 | 1.5 | 1.75 | 1.75 |

| | Ex. 12 | Ex. 13 | Ex. 14 | Ex. 15 |
|---|---|---|---|---|
| $C_{10}$-$C_{14}$benzene sulfonate, sodium salt (80%) | 31 | 31.5 | 29.9 | 30.2 |
| lauryl monoethanol amide (98%) | 1.5 | — | 1.5 | 1.5 |
| alkene sulfonate, sodium salt, | 36 | 38 | 36.5 | 36.5 |
| $C_{12}$-$C_{16}$ ethoxy (2-3 EO) sulfate, sodium salt (70%) | — | — | 0.8 | |
| silica | 2 | 2 | 2 | 2 |
| sodium sulfate | 21 | 21 | 21 | 21 |
| sulfamic acid | — | — | — | |
| citric acid | 4.5 | 2.5 | 4 | 4.2 |
| sodium bicarbonate | — | 1 | — | |
| polyoxyethylene (16) tallow ethylammonioum ethosfulfate (100%) | 2.5 | 2.5 | 2.8 | 2.8 |
| DI water | 1.5 | 1.5 | 1.5 | 1.8 |

| | Ex. 16 | Ex. 17 |
|---|---|---|
| sodium dodecyl benzene sulfonate, sodium salt (80%) | 26 | 26 |
| C14/C16 olefin sulfonate, sodium salt (80%) | 36 | 36 |
| sodium sulfate | 24.5 | 24.5 |
| lauryl monoethanol amide (98%) | 2 | 2 |
| silica | 2 | 2 |
| citric acid | 4.5 | 4.5 |
| sodium lauryl ether sulfate (70%) | 2.0 | 2.0 |
| SOKALAN HP70 | 3.0 | — |
| SOKALAN CP-9 | — | 3.0 |
| DI water | 1.5 | 1.5 |

The identity of the constituents used to form the treatment blocks are identified more specifically on the following Table 2. The individual constituents were used "as supplied" from their respective suppliers and may constitute less than 100% wt, or 100% wt. of the named compound, as indicated in Tables 1 and 2.

TABLE 2

| | |
|---|---|
| $C_{10}$-$C_{14}$benzene sulfonate, sodium salt (80%) | anionic surfactant, dodecylbenzene sulfonate, 80% wt. actives, supplied as NANSA HS 80/PF |
| sodium dodecyl benzene sulfonate, sodium salt (80%) | sodium dodecyl benzene sulfonate, sodium salt (80%), supplied as NANSA HS 80/PF |
| lauryl monoethanol amide (98%) | lauryl monoethanol amide, 98% wt. actives |
| alkene sulfonate, sodium salt, | alkene sulfonate, sodium salt, 100% wt. actives, supplied as NANSA LSS 480/H, or other equivalent material |
| C14/C16 olefin sulfonate, sodium salt (80%) | C14/C16 olefin sulfonate, sodium salt (80% wt. actives), supplied as NANSA LSS 480/H, or other equivalent material |
| $C_{12}$-$C_{16}$ ethoxy (2-3 EO) sulfate, sodium salt (70%) | $C_{12}$-$C_{16}$ ethoxy (2-3 EO) sulfate, sodium salt, 70% wt. actives, supplied as EMPICOL ESB 70 or other equivalent material |
| sodium lauryl ether sulfate (70%) | sodium lauryl ether sulfate (80% wt. actives), supplied as EMPICOL ESB 70 or other equivalent material |
| silica | filler anhydrous silica, 100% wt. actives. supplied as MICROSIL ED, or other equivalent material |
| sodium sulfate | anhydrous sodium sulfate, 100% wt. actives |

TABLE 2-continued

| | |
|---|---|
| citric acid | anhydrous citric acid, 100% wt. actives |
| sulfamic acid | anhydrous sulfamic acid, 100% wt. actives |
| sodium bicarbonate | anhydrous sodium bicarbonate, 100% wt. actives |
| 3-(trimethoxysilyl)propyloctadecyldimethyl ammonium chloride (72%) | supplied as AEM 5772, 72% wt. actives (ex. Aegis Environmental Co.,) |
| polyoxyethylene (16) tallow ethylammonioum ethosfulfate | supplied as CRODAQAT TES, 100% wt. actives (ex. Croda) |
| SOKALAN HP70 | amphoteric organic polynitrogen compound, 35%-35% wt. actives (ex. BASF) |
| SOKALAN CP-9 | maleic acid-di-isobutylene copolymer, 25% wt. actives (ex. BASF) |
| DI water | deionized water |

First, the film forming constituent is blended with all or part of the added water indicated in the formulation to form an aqueous solution or dispersion of the film forming constituent. Thereafter the aqueous solution or dispersion is sprayed onto one or more of the remaining constituents in order to ensue that the film forming constituents are evenly and homogenously dispersed within the solid block compositions. Next, all of the anhydrous constituents, (excluding the bleach constituent, if present) are dry blended to form a premixture, which is subsequently metered concurrently with appropriate metered amounts of the aqueous premixture containing the film forming constituent (and if present, the bleach constituent) into the throat of a twin-screw extruder. Alternately the aqueous premixture containing the film forming constituent (and if present, the bleach constituent) may be injected into the extruder barrel at a point downstream of the throat. When present, the hydrocarbon solvent constituent is also advantageously injected into the extruder barrel at a point downstream of the throat, advantageously at a port located about one-third of the distance of the length of the extruder barrel downstream of the throat. When necessary or desirable, water may be provided at a point downstream of the extruder throat in order to improve the processing or homogeneity of the extrudate. The twin-screw extruder is operated at low temperatures and pressures, The twin-screw extruder is used to form a homogeneous blend of the solid block constituents. Subsequently the exiting homogenous blend exiting the twin-screw extruder is supplied to the throat of s single screw extruder which is used to compress the homogenous blend into a solid mass. The single screw extruder operates at about 35-50° C., and the extruded solid mass exits a circular die having a diameter in the range of 30-65 millimeters heated to about 65-80° C. Upon exiting the circular die, the solid mass is cut into short cylindrical blocks having an approximate mass of between about 25-65 grams.

The treatment blocks exhibit good dimensional stability both after manufacture and prior to use in the cleaning treatment of a sanitary appliance, e.g., a toilet or urinal, as well as during the cleaning treatment of a sanitary appliance. The film forming constituents are deposited on the hard surfaces which are contacted when these constituents are dissolved or flushed from the block, and deposit a film on these surfaces which retards the buildup of stains thereon and also, act as an intermediate barrier layer for hydrophobic stains which deposit on the deposited film forming polymer which is later dissolved by water. Thus, the film forming polymer provides in part a replenishable water washable barrier coating to all or parts of the hard surface, e.g., lavatory appliance especially toilet to which it is applied.

TESTING

Certain of the foregoing example compositions, namely compositions according to Ex. 16 and Ex. 17 were tested to evaluate the efficacy of a compressed solid blocks formed from the aforesaid compositions in controlling the buildup of limescale in a toilet bowl. In accordance with the tests, blocks of similar mass were produced by separately extruding compositions according to Ex. 16 and Ex. 17 in the manner described above each of which blocks was then provided to identical conventional ITB cages. Cages containing the extruded compositions were then suspended in a conventional manner from the rim of a white toilet bowl, and then toilet was operated to in order to automatically flush the toilets 24 time per day, for a total of 236 total flushes for compositions according to Ex. 17, or 332 total flushes for compositions according to Ex. 16. All testing was performed at approximately room temperature (19-22° C.). Each of the toilets were periodically and automatically flushed by a machine-controlled device which operated the toilets In each flush cycle, the cistern (tank) of the toilet released approximately 13 liters of water into the bowl, part of which impinged on the ITB cage containing a block composition. At the conclusion of each of the foregoing tests it was observed that each of the lavatory blocks was either wholly consumed, or nearly wholly consumed. For each of the compositions according to Ex. 16 and Ex. 17, two replicates were tested.

Figure 2:
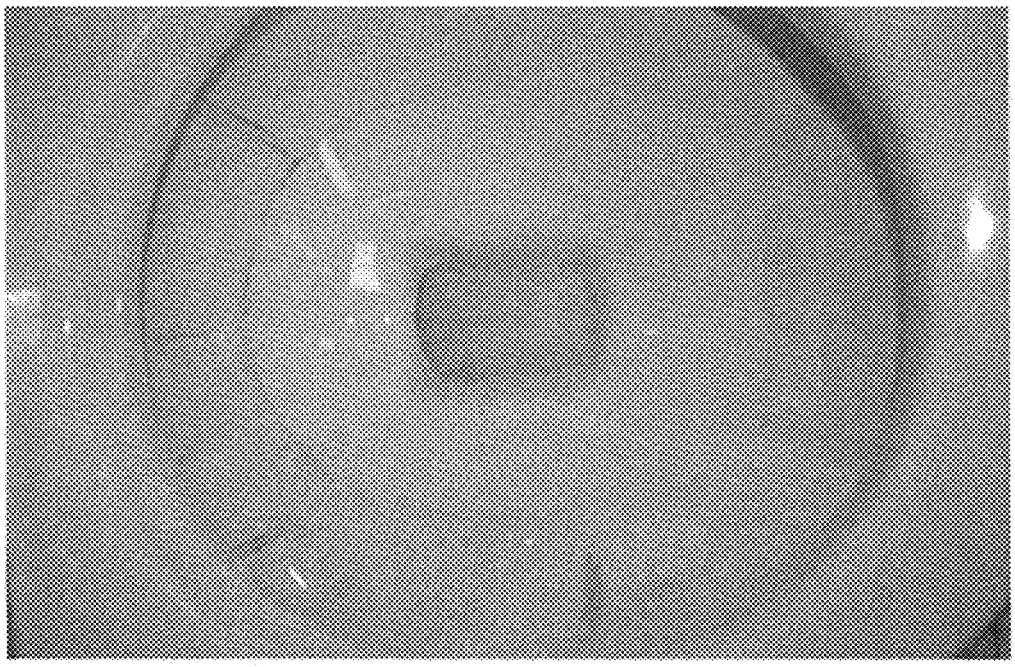
Figure 3:
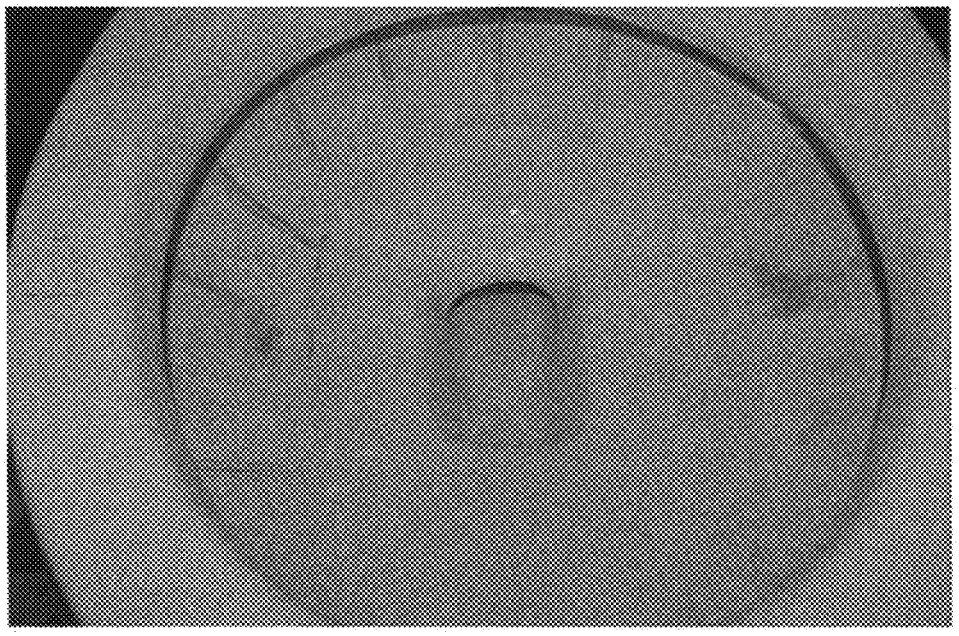
FIGS. 3 and 4 are photographs of the interior of a toilet bowl treated with a further ITB block having a further composition according to the present invention.
Figure 4:
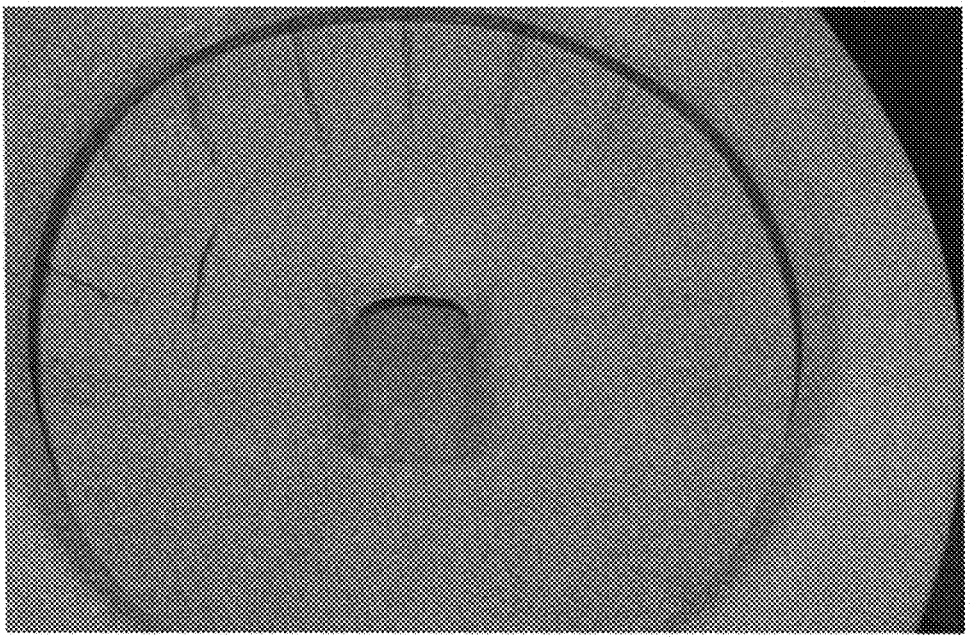

Subsequently the ITB cages were removed from the toilets and a 0.2% w/w aqueous solution of alizarin red monohydrate was dispensed from a compressible nozzled bottle to the interior surfaces of each of the toilet bowls. The results of this testing is disclosed on accompanying FIGS. 1-4, wherein FIGS. 1 and 2 are photographs of the interior of a toilet bowl treated with an ITB block formed from a block composition according to Ex. 16, and wherein FIGS. 3 and 4 2 are photographs of the interior of a toilet bowl treated with an ITB block formed from a block composition according to Ex. 17 As is visible on the figures, the alizarin red monohydrate reached with or adhered to limescale present on the interior surfaces of each of the toilet bowls and functioned as a developer or stain, more clearly revealing the presence of the limescale. As is visible therefrom, in all instances the bottom region of each toilet bowl which was normally submerged in water between flushes exhibited excellent product performance as is evidenced by the absence of any limescale present, and in other regions of the toilet bowl above the water line defined by the top surface of the water present in the toilet bowl between flushes, good product performance was evident as is seen from the lack of limescale on most of the these interior bowl surfaces above the water line. Such indicates the formation of a protective film layer, although not necessary a continuous film layer which nonetheless provided excellent resistance to limescale buildup and protection against limescale deposition on interior surfaces of the toilet bowl consequent upon the use of the compositions according to the invention.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. An In the Cistern or In the Bowl toilet bowl treatment block which delivers a treatment composition to a toilet bowl formed from a solid toilet bowl treatment block composition which composition comprises:

polynitrogen compounds, present in an amount of up to about 1% wt. and, at least one anionic surfactant compound selected from one or more of: alcohol sulfates and sulfonates, alcohol phosphates and phosphonates, alkyl ester sulfates, linear alkyl benzene sulfonates, alkyl diphenyl ether sulfonates, alkyl sulfates, alkyl ether sulfates, sulfate esters of an alkylphenoxy polyoxyethylene ethanol, alkyl monoglyceride sulfates, alkyl sulfonates, olefin sulfonates, beta-alkoxy alkane sulfonates, alkyl ether sulfonates, ethoxylated alkyl sulfonates, alkylaryl sulfonates, alkylaryl sulfates, alkyl monoglyceride sulfonates, alkyl carboxylates, alkyl ether carboxylates, alkyl alkoxy carboxylates having 1 to 5 moles of ethylene oxide, alkylpolyglycolethersulfates (containing up to 10 moles of ethylene oxide), sulfosuccinates, octoxynol or nonoxynol phosphates, taurates, fatty taurides, fatty acid amide polyoxyethylene sulfates, acyl glycerol sulfonates, fatty oleyl glycerol sulfates, alkyl phenol ethylene oxide ether sulfates, paraffin sulfonates, alkyl phosphates, isethionates, N-acyl taurates, alkyl succinamates and sulfosuccinates, alkylpolysaccharide sulfates, alkylpolyglucoside sulfates, alkyl polyethoxy carboxylates, and sarcosinates.

2. A toilet bowl treatment block composition according to claim 1 wherein the polynitrogen compound is a film forming constituent.

3. A toilet bowl treatment block composition according to claim 2 wherein the polynitrogen compound is an amphoteric polyamide polymer.

4. An In the Cistern or In the Bowl device adapted to be installed in a toilet which contains a toilet bowl treatment block composition according to claim 1.

5. A method of reducing limescale deposition on hard surfaces of a lavatory appliance which method comprises the steps of:

providing a toilet bowl treatment block according to claim 1 and placing the treatment block in the path of flush water supplied to the lavatory appliance such that the flush water contacts the toilet bowl treatment block and dissolves at least a part of the toilet bowl treatment block in order to form a treatment composition, and providing the treatment composition to the interior surfaces of the toilet bowl.

* * * * *